US009062935B2

(12) United States Patent
Adams et al.

(10) Patent No.: US 9,062,935 B2
(45) Date of Patent: Jun. 23, 2015

(54) AUTOMATIC PIN ADJUSTMENT FOR ARCHERY SIGHTS

(71) Applicant: Bear Archery, Inc., Evansville, IN (US)

(72) Inventors: Brian J. Adams, Vincennes, IN (US); Jack Bowman, Boonville, IN (US); Jeffrey Alan Wassmer, Evansville, IN (US); David Eugene Hahn, Elberfeld, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 14/547,193

(22) Filed: Nov. 19, 2014

(65) Prior Publication Data

US 2015/0068051 A1 Mar. 12, 2015

Related U.S. Application Data

(63) Continuation of application No. 14/204,072, filed on Mar. 11, 2014, now Pat. No. 8,914,984, which is a continuation of application No. PCT/US2012/054812, filed on Sep. 12, 2012, which is a continuation of application No. 13/604,142, filed on Sep. 5, 2012, now Pat. No. 8,561,308.

(60) Provisional application No. 61/536,170, filed on Sep. 19, 2011, provisional application No. 61/562,135, filed on Nov. 21, 2011, provisional application No. 61/625,295, filed on Apr. 17, 2012.

(51) Int. Cl.
*F41G 1/467* (2006.01)
*F41B 5/14* (2006.01)

(52) U.S. Cl.
CPC .. *F41G 1/467* (2013.01); *F41B 5/14* (2013.01)

(58) Field of Classification Search
CPC ..... F41G 1/467; F41G 1/345; F41G 1/30; F41B 5/14
USPC ..... 33/265; 124/87
See application file for complete search history.

(56) References Cited

U.S. PATENT DOCUMENTS

| | | | | |
|---|---|---|---|---|
| 3,674,002 | A | 7/1972 | Diamond, Sr. | |
| 4,153,999 | A | 5/1979 | O'Steen | |
| 4,309,827 | A * | 1/1982 | Larson | 33/265 |
| 4,535,747 | A | 8/1985 | Kudlacek | |
| 4,689,887 | A | 9/1987 | Colvin | |
| 4,846,141 | A | 7/1989 | Johnson | |
| 4,984,373 | A | 1/1991 | Forrest | |
| 5,072,716 | A | 12/1991 | Sappington | |
| 5,103,568 | A | 4/1992 | Canoy | |
| 5,228,204 | A | 7/1993 | Khoshnood | |
| 5,239,760 | A | 8/1993 | Dixon et al. | |
| 5,384,966 | A | 1/1995 | Gibbs | |
| 5,676,122 | A * | 10/1997 | Wiseby et al. | 124/87 |

(Continued)

OTHER PUBLICATIONS

International Search Report and Written Opinion issued in PCT/US2012/054812, dated Feb. 26, 2013.

*Primary Examiner* — Yaritza Guadalupe-McCall
(74) *Attorney, Agent, or Firm* — Woodard, Emhardt, Moriarty, McNett & Henry LLP

(57) ABSTRACT

Certain embodiments of the present disclosure deal with an archery sight mounted or mountable on an archery bow. The sight incorporates an indicator or adjustment assembly to indicate or control the desired position of one or more additional sight pins based on sighted in positions of two base sight pins.

18 Claims, 34 Drawing Sheets

(56) References Cited

U.S. PATENT DOCUMENTS

| | | | | |
|---|---|---|---|---|
| RE36,266 | E | 8/1999 | Gibbs | |
| 5,946,812 | A | 9/1999 | Slates | |
| 6,061,919 | A | 5/2000 | Reichert | |
| 6,564,462 | B1 * | 5/2003 | Henry | 33/265 |
| 6,618,949 | B1 | 9/2003 | Keener | |
| 6,796,039 | B2 | 9/2004 | Walbrink | |
| 6,802,129 | B1 * | 10/2004 | Wirth | 33/265 |
| 6,823,597 | B2 * | 11/2004 | Larson | 33/265 |
| 7,086,161 | B2 | 8/2006 | Ellig et al. | |
| 7,278,216 | B2 | 10/2007 | Grace | |
| 7,308,891 | B2 | 12/2007 | Graf | |
| 7,328,515 | B2 * | 2/2008 | Helm et al. | 33/265 |
| 7,392,590 | B2 | 7/2008 | Gordon | |
| 7,721,453 | B1 | 5/2010 | Young | |
| 8,046,927 | B1 * | 11/2011 | Edmundson | 33/265 |
| 8,250,769 | B2 * | 8/2012 | Edmundson | 33/265 |
| 8,561,308 | B2 * | 10/2013 | Adams et al. | 33/265 |
| 8,914,984 | B2 * | 12/2014 | Adams et al. | 33/265 |
| 2007/0220761 | A1 * | 9/2007 | Helm et al. | 33/265 |
| 2008/0010841 | A1 | 1/2008 | Gordon | |
| 2009/0000134 | A1 | 1/2009 | Kurtzhals et al. | |
| 2009/0139100 | A1 | 6/2009 | Kingsbury | |
| 2013/0067756 | A1 * | 3/2013 | Adams et al. | 33/265 |
| 2015/0026991 | A1 * | 1/2015 | Hahn | 33/265 |
| 2015/0068051 | A1 * | 3/2015 | Adams et al. | 33/265 |

* cited by examiner

AUTOMATIC PIN ADJUSTMENT FOR ARCHERY SIGHTS

CROSS-REFERENCE TO RELATED APPLICATIONS

This application is a continuation of U.S. Utility application Ser. No. 14/204,072 filed Mar. 11, 2014 which claims the benefit of International Application No. PCT/US2012/054812 filed Sep. 12, 2012, which claims the benefit of U.S. Utility patent application Ser. No. 13/604,142 filed on Sep. 5, 2012; U.S. Provisional Patent Application Ser. No. 61/536,170 filed on Sep. 19, 2011; Provisional Application Ser. No. 61/562,135 filed on Nov. 21, 2011; and Provisional Application Ser. No. 61/625,295 filed on Apr. 17, 2012, all of which are incorporated herein by reference in their entirety.

FIELD OF THE INVENTION

Aspects of the present invention deal with archery bows, and in particular deal with accessories such as sights usable with archery bows.

BACKGROUND OF THE INVENTION

A bow sight can be used to assist an archer in aiming a bow. A typical bow sight includes a sight housing secured to the frame of a bow by one or more brackets. The sight housing often defines a viewing opening (i.e., a sight window) through which an archer can frame a target. The bow sight also typically includes at least one sighting member, such as a pin, that projects into the viewing opening. The sighting member defines and supports a sight point. The sight point is the point the archer aligns with the target during aiming. In use, the archer draws the drawstring of the bow and adjusts the position of the bow so that the intended target is visible through the viewing opening. While continuing to peer through the viewing opening with the bowstring drawn, the archer adjusts the position of the bow so that the sight point aligns with the intended target from the archer's eye. Once the sight point is aligned with the intended target, the archer releases the bowstring to shoot the arrow. "Target" herein can mean either a target being hunted or a fixed target. One example of a vertically adjustable sight is illustrated in U.S. Pat. No. 7,275,328.

The vertical position of one or more sight points is preferably set and calibrated to the user and bow so that each sight point position corresponds to a different target distance. Multiple sighting members are generally arranged in either a vertically aligned orientation, such as discussed in U.S. Pat. No. 6,418,633 or a horizontal orientation, such as discussed in U.S. Pat. No. 5,103,568. In certain embodiments, the sight points can be adjusted vertically to calibrate the sight points for differing target distances. Lower sight point positions typically correspond to longer target distances.

Adjustment of multiple sight pins for different distances often involves an archer, through trial and error, "sighting in" the bow at each distance so that each sight point position is accurately associated with a particular target distance. An alternate approach is to use computer software based on bow speed and other variables to prepare and print a sight tape which is then mounted on the bow sight and provides guidance for individually adjusting sight pins for various target distances. A still alternate approach, as discussed in U.S. Pat. No. 7,392,590, uses a multi-pitch lead screw to simultaneously adjust multiple sight pins.

SUMMARY OF THE INVENTION

In certain embodiments, an archery sight is mounted or mountable on an archery bow which includes a riser with a handle, upper and lower limb portions extending from the handle to limb tip sections and rotational members supported at the limb tip sections. A bowstring extends between the rotational members. The sight is typically secured to the riser. The sight incorporates an indicator or adjustment assembly to indicate or control the desired position of one or more additional sight pins based on sighted in positions of two base sight pins.

Certain embodiments include archery bow sights which incorporate pin adjustment mechanisms which can be set to automatically arrange sight pins or to indicate sight pin placement points in appropriate proportional spacing for various target ranges based on the spacing measured for two initial points. In certain embodiments, a first pin on an archery bow sight is calibrated at a first reference distance to define a first reference point on the sight. A first alignment point on the mechanism is then calibrated to the first reference point. The bow and sight is then used at a second reference distance to determine a second reference point for a second sight pin. A second alignment point on the mechanism is then adjusted to align with the second reference point. As aligned, the mechanism then defines one or more additional proportionately spaced alignment points where additional sight pins will correspond with additional reference distances. In some embodiments, adjustment of the second alignment point on the mechanism correspondingly automatically adjusts additional sight pins. In alternate embodiments, alignment points on the mechanism define locations to which sight pins can be manually adjusted.

Additional objects and advantages of the described embodiments are apparent from the discussions and drawings herein.

DESCRIPTION OF PREFERRED EMBODIMENTS

Figure 1:
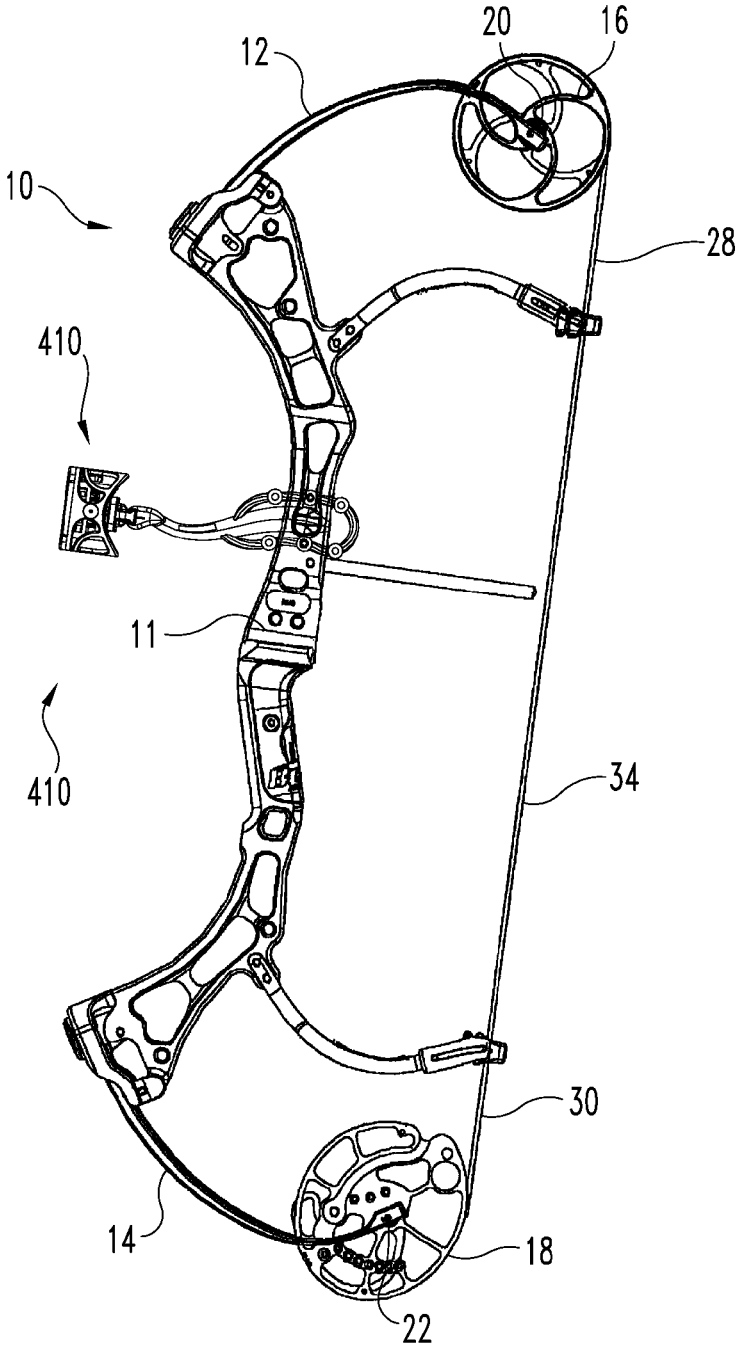
FIG. 1 is a perspective view of an archery bow including an embodiment of a sight assembly as disclosed herein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Certain embodiments include archery bow sights which incorporate pin adjustment mechanisms which can be set to automatically arrange sight pins or to indicate sight pin placement points in appropriate proportional spacing for various target ranges based on the spacing measured for two initial points. In certain embodiments, a first pin on an archery bow sight is calibrated at a first reference distance to define a first reference point on the sight. A first alignment point on the mechanism is then calibrated to the first reference point. The bow and sight is then used at a second reference distance to determine a second reference point for a second sight pin. A second alignment point on the mechanism is then adjusted to align with the second reference point. As aligned, the mechanism then defines one or more additional proportionately spaced alignment points where additional sight pins will correspond with additional reference distances. In some embodiments, adjustment of the second alignment point on the mechanism correspondingly automatically adjusts additional sight pins. In alternate embodiments, alignment points on the mechanism define locations to which sight pins can be manually adjusted.

FIG. 1 illustrates one example of a conventional single cam compound archery bow generally designated as 10. When viewed from the perspective of an archer holding the bow 10, it includes a riser 11 with a handle and an arrow rest, an upper limb portion 12 and a lower limb portion 14. Rotational members forming one or two variable leverage units such as idler wheel 16 and eccentric cam 18 are supported at the limb tip sections for rotary movement about axles 20 and 22. Idler wheel 16 is carried between the outer limb tip portions of upper limb 12. The cam 18 is carried between the outer limb tip portions of lower limb 14.

Bowstring 34 (shown as a tangent line without full cabling for convenient illustration) includes upper end 28 and lower end 30 which are fed-out from idler wheel 16 and cam 18 when the bow is drawn. Bowstring 34 is mounted around idler wheel 16 and cam 18 as is known in the art. From the perspective of the archer, the bowstring is considered rearward relative to the riser which defines forward.

When the bowstring 34 is drawn, it causes idler wheel 16 and cam 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing idler wheel 16 and cam 18 to rotate in the opposite direction, to take up the bowstring 34 and launch the arrow with an amount of energy proportional to the energy stored in the bow limbs. Bow 10 is described for illustration and context and is not intended to be limiting. The present invention can be used with dual-cam compound bows, or can be used with single-cam bows as described for example in U.S. Pat. No. 5,368,006 to McPherson, hereby incorporated herein by reference. It can also be used with hybrid cam bows or recurve bows. The present invention can also be used in other types of bows, which are considered conventional for purposes of the present invention.

Figure 2:
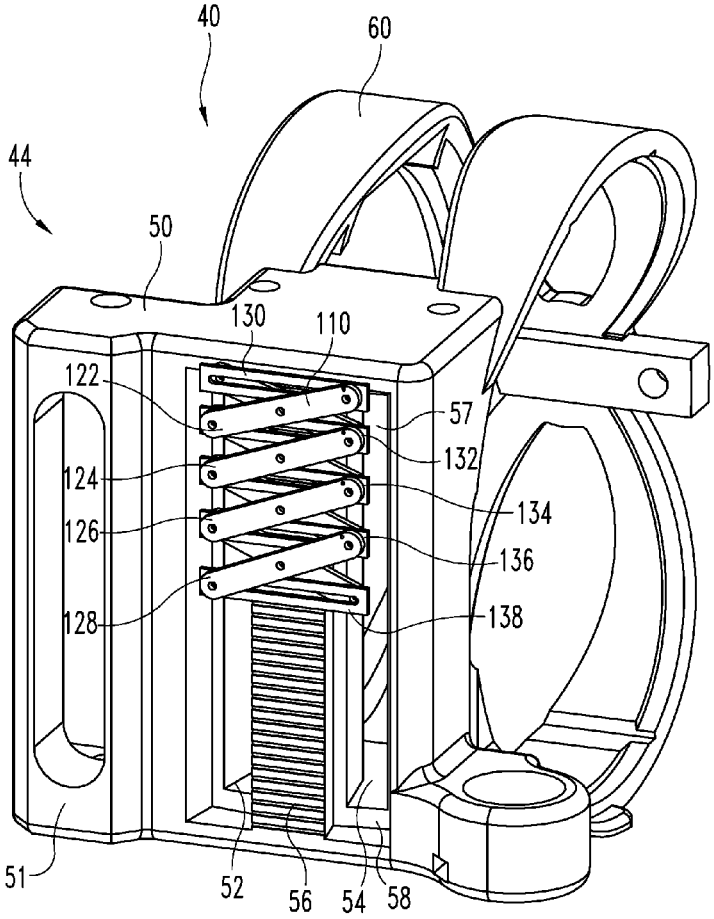
FIG. 2 is a perspective view of a sight assembly according to one embodiment.

FIG. 2 illustrates a perspective view of an archery sight assembly according to certain embodiments of the disclosure. The sight assembly 40 includes a movable body portion or assembly 44, which may be attached to a rearward portion, for example, with windage clamps. The body portion includes a sight block 50 from which extends a sight guard 60 which typically defines the viewing window or opening. One or more sight points are defined by one or more pins (not shown in FIG. 2) mounted to the sight block and which extend into the viewing window of sight guard 60. In certain embodiments, the one or more pins incorporate fiber optic strands to collect and deliver light to the sight point to enhance visibility. The fiber optic strands can be coiled on or adjacent the pins or the sight guard 60. Other sight features such as a battery powered sight light or a level can optionally be used with the sight guard and sight pins.

In certain embodiments, body assembly 44 is arranged to move or translate vertically and/or horizontally relative to a rearward base portion. Translational movement of body assembly 44 correspondingly vertically or horizontally moves the entirety of the sight guard assembly and the sight pins relative to the bow riser and arrow rest. In certain embodiments, the body assembly is horizontally adjusted to horizontally calibrate the sight pins with a particular archer and bow. Separately, in certain embodiments the body assembly is vertically adjusted to vertically calibrate the bow using a first sight pin with a first reference distance to a target.

Sight pin adjustment mechanisms according to preferred embodiments herein assist an archer to calibrate a plurality of sight pins to different reference distances. For example, once the first sight pin is calibrated to a first reference distance, the bow is shot using a second sight pin at a second reference distance to calibrate the second sight pin to the second reference distance. More specifically, the bow is shot at a second reference distance and the sight pin is adjusted relative to the first sight pin to calibrate it to the selected distance. Adjustment of the second sight pin can automatically adjust one or more additional sight pins at proportionally spaced intervals to correspond to additional reference distances or the second sight pin can be aligned with a second reference point on the sight pin adjustment mechanism, wherein the adjustment of the sight pin adjustment mechanism automatically adjusts additional reference points which indicate where one or more additional sight pins should be positioned to match additional reference distances.

Using laws of physics and geometry, a range formula can be applied to the travel of an arrow from an archery bow where the horizontal distance traveled is proportional to the angle of launch. More specifically, a formula of:

$$x=(v^2 \sin 2\theta)/g^2$$

applies where "x" is the horizontal distance of travel, "v" is the launch velocity of the arrow from the bow, "θ" is the angle of launch and "g" is the acceleration due to gravity. Assuming a bow with a consistent launch velocity, the horizontal travel distance for a specific bow and arrow can be calculated and is proportional to the sine of twice the launch angle.

For purposes of the present mechanism, a reference or zero degree line for calculating the angle of arrow launch can be defined as a horizontal line extending from a point closely adjacent to the archer's eye, through the sight, intersecting a first sight pin and then to a target point at a first defined distance. The distance from the archer's eye to the sight pin is proportional to the draw length of the bow and is assumed to be constant for a specific archer and bow. For example, when a first sight pin on a 27" draw length bow is calibrated at 20 yards, the zero degree line can be defined as a line including approximately 27" from the archer's eye to the first sight pin plus 20 yards to a target. Using the above formula and knowing the velocity of the bow, the angles for additional reference distances such as 30, 40, 50 yards, etc. relative to the reference line and the archery's eye can also be calculated. These angles can then be applied using the distance from the archer's eye to the sight to define the offset height of additional sight pins relative to the first sight pin. Offset heights for longer distances would typically be measured downward relative to a pin calibrated for a shorter distance.

The spacing of the respective pins as calculated above follows a proportional spacing pattern governed by the range formula. Aspects of the adjustment mechanisms herein take advantage of this pattern to adjust multiple sight pins to fit the appropriate pattern for a specific archer and bow without needing to measure or know the actual distance from the archer's eye to the sight pins or the actual bow speed. Instead, those variables are assumed to be constant. Then, by adjusting the mechanism to fit two alignment points to two reference points which are already known to fit the pattern, additional properly proportionally spaced alignment points will automatically fit the pattern. In other words, sight adjustment mechanisms herein constrain multiple pins or alignment points to only adjust relative to each other in a proportional pattern governed by the range formula. Thus, if two points, such as a 20 yard point and a 60 yard point are aligned with measured actual points for 20 and 60 yards respectively, the remaining alignment points will automatically indicate the desired points for sight pins for 30, 40, 50 yards, etc.

An example sight assembly is illustrated in FIGS. 2-6. Sight assembly 40 includes a body assembly 44 having a sight block 50 which can be adjustably secured to a base portion. A sight guard 60 extends from sight block 50 and defines a viewing window, typically with sight pins therein. Sight block 50 defines slots or tracks 52 and 54 separated by central pillar 56. A plurality of sight pins may be adjustably mounted in the slots between an upper end 57 and a lower end 58 of one or both slots.

Adjustment mechanism 110 is mounted adjacent the sight pin slots or tracks. Adjustment mechanism 110 includes a linkage arrangement including pairs of linkage arms 122, 124, 126 and 128, and horizontal alignment bars 130, 132, 134, 136 and 138. Preferably an upper end of mechanism 110, such as the first horizontal bar 130 is mounted adjacent upper track end 57 parallel to a horizontal reference axis defined through the sight window, and the adjustment mechanism 110 can be expanded or retracted vertically downward relative to the first horizontal bar 130.

Figure 3:
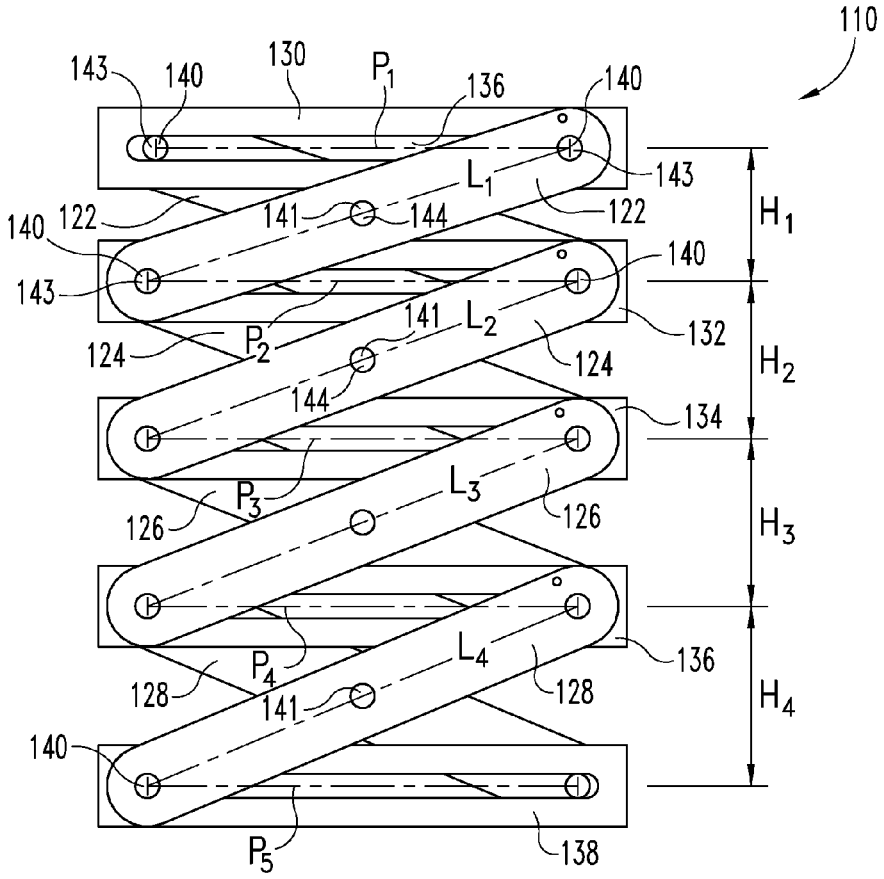
FIG. 3 is a front view of an adjustment mechanism as illustrated in the sight assembly of FIG. 2.
Figure 4:
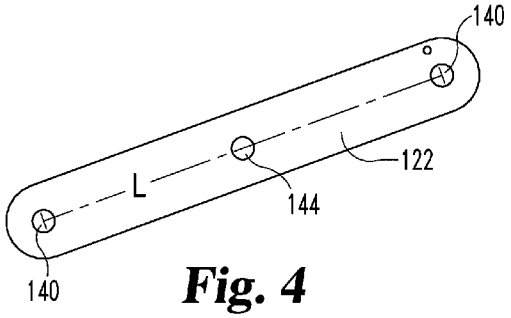
FIG. 4 is a front view of a linkage arm of the adjustment mechanism of FIG. 2.

The linkage arrangement of mechanism 110 is illustrated in detail in FIG. 3. A detailed example of linkage arm 122 forming one arm of a pair is illustrated in FIG. 4. Linkage arm 122 defines two end pivot points 140, with a length L defined between the end pivot points. Arm 122 also defines a central pivot point 141. Although different in length, additional linkage arms 124, 126 and 128 are substantially similar in structure to linkage arm 122.

Figure 5A:
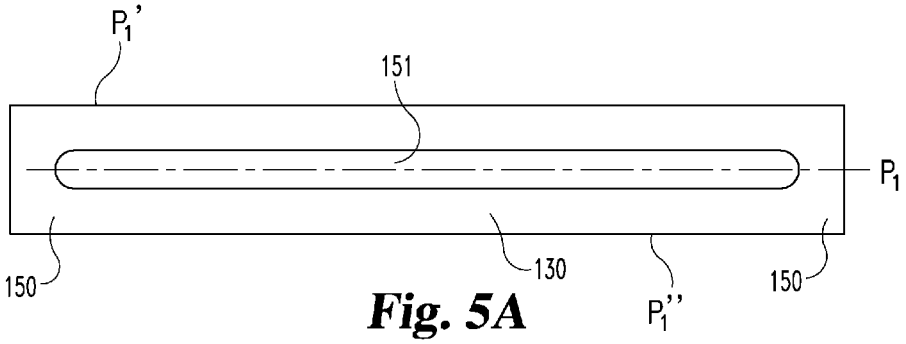
FIGS. 5A-C are front views of alignment bar embodiments usable in the adjustment mechanism of FIG. 2.
Figure 5B:
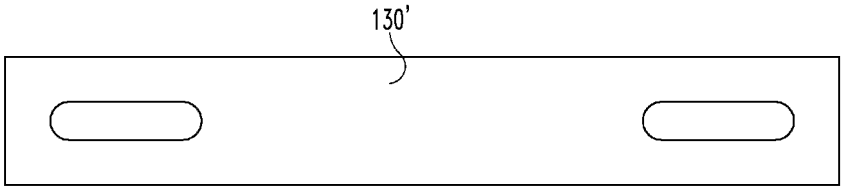
Figure 5C:
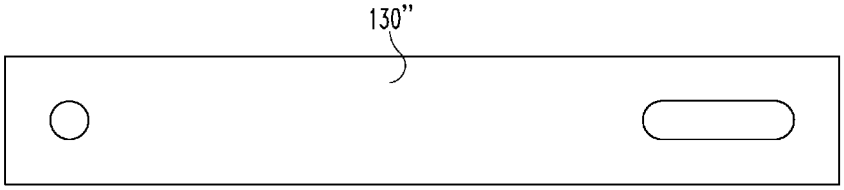
Figure 6:
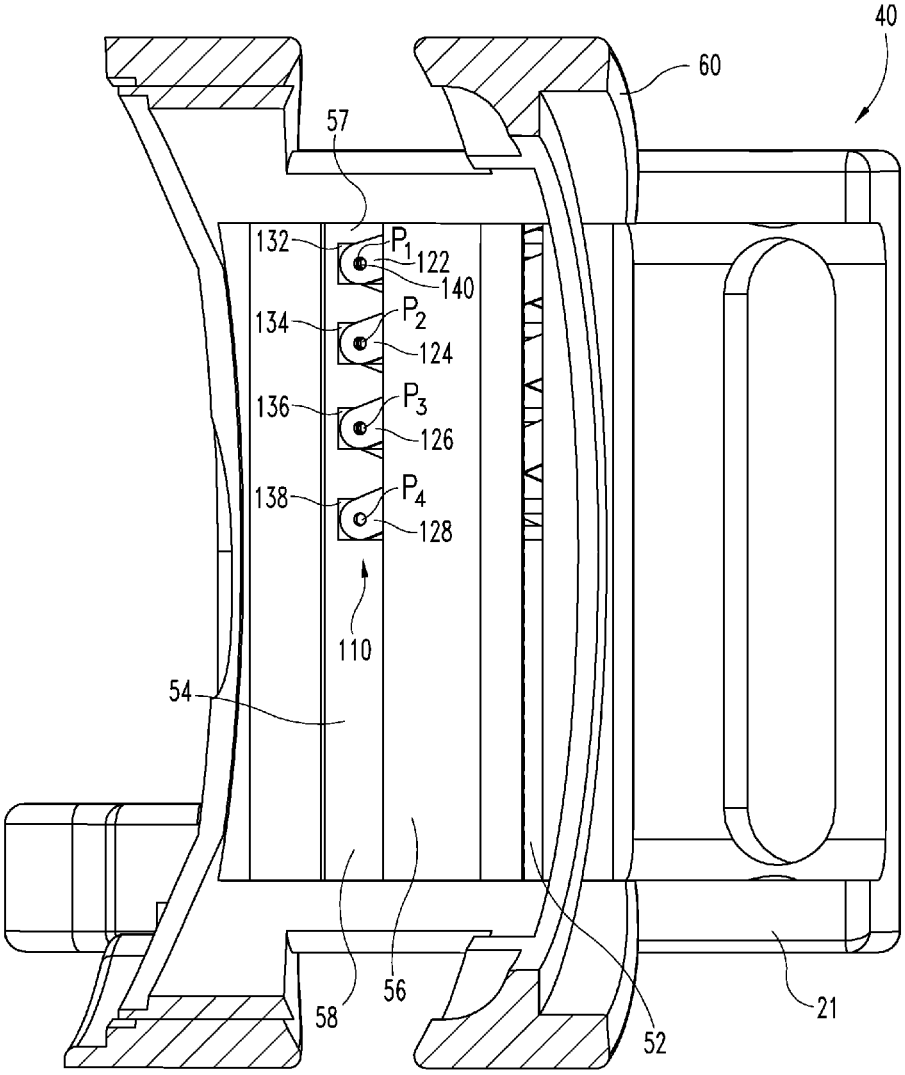
FIG. 6 is an interior, cross-sectional view within a sight guard looking outward of the a sight assembly of FIG. 2.

An example horizontal bar 130 is illustrated in FIG. 5A. Bar 130 includes opposing ends 150. The length of bar 130 defines an interior track or slot 151. Alternately, the track can be formed with one or two short slots adjacent the ends, as shown with bars 130' and 130" in FIGS. 5B and 5C, rather than one long slot. Bar 130 defines a horizontal sight pin axis, which can be illustrated as central axis $P_1$, or alternately a parallel axis $P_1'$ or $P_1''$ along the upper or lower edge of the bar can be used. Alternately, other arrangements allowing sliding and rotational motion of linkage arms relative to a bar, such as a groove or track with a slider and pivot can be used. Horizontal bars 132, 134, 136, and 138 are substantially similar to bar 130.

In the illustrated embodiment, horizontal bar 130 forms the upper base of mechanism 110 and defines a horizontal axis $P_1$. Pairs of linkage arms 122, 124, 126 and 128 each form a pivotal "x" arrangement with the central pivot points 141 of each pair of linkage arms pivotally connected to each other, for example using pivot pins 144. Optionally, a spacer may fill the area along pivot pin 144 between a pair of arms.

The first pair of linkage arms 122 extends downward from bar 130. The upper pivot end point 140 of each of linkage arms 122 is rotatably and slidably mounted to bar 130, such as in slot 151, for example using pivot pins 143. In the illustrated embodiments, the upper pivot ends are on opposing sides of bar 130, but such an arrangement is optional. The lower pivot end point 140 of each of linkage arms 122 is rotatably and slidably mounted to a second horizontal bar 132 such as in a slot, for example using pivot pins 143. The pivot pins 143 form shared pivot points 140 with the upper ends of the next pair of linkage arms 124. As illustrated, pivot pins 143 extend from a linkage arm through a horizontal bar to a different linkage arm; however, different arrangements can be used instead.

Similarly, the lower pivot end points 140 of each pair of linkage arms 124 and 126 are rotatably and slidably mounted in a slot 151 of a horizontal bar 134 and 136 respectively, which form shared pivot points with the upper ends of the next pair of linkage arms 126 and 128 respectively. The lower pivot end points of the lowest pair of linkage arms 128 are rotatably and slidably mounted to the lowest horizontal arm 138. The present arrangement is illustrated with four pairs of linkage arms and five horizontal bars. Optionally, more or less pairs of linkage arms and horizontal arms can be used as desired. In certain options, one or more of the horizontal bars can be omitted.

In arrangement 110, the horizontal bars 130, 132, 134, 136 and 138 and slots 151 may have a standard length; however, the lengths of linkage arms 122, 124, 126 and 128 are not equal. For example, the length of linkage arms 122 is $L_1$, the length of linkage arms 124 is $L_2$, the length of linkage arms 126 is $L_3$ and the length of linkage arms 128 is $L_4$, where $L_1<L_2<L_3<L_4$. As a non-limiting example, example measurements could be $L_1$=0.80954", $L_2$=0.81794", $L_3$=0.82172" and $L_4$=0.82465".

Using linkage arms of different lengths, the "x" pairs of linkage arms maintain distances between the respective horizontal bars which are proportionally governed relative to each other and the reference horizontal bar 130. For example, pivot points 140 arranged in bar 132 define a variable height $H_1$ relative to the pivot points 140 in bar 130. Pivot points 140 arranged in bar 134 define a variable height $H_2$ relative to the pivot points 140 in bar 132, pivot points 140 arranged in bar 136 define a variable height $H_3$ relative to the pivot points 140 in bar 134, and pivot points 140 arranged in bar 138 define a variable height $H_4$ relative to the pivot points 140 in bar 136. The pivot points also define a horizontal sight point axis through each horizontal bar, for example $P_1$, $P_2$, $P_3$, $P_4$ and $P_5$ respectively. The horizontal axis lines may alternately be used as the reference lines if one or more of the horizontal bars are optionally omitted.

During expansion and contraction of mechanism 110, the connected pairs of linkage arms will act upon each other so that the pivot points 140 in all of the horizontal bars travel or are displaced the same horizontal distance. This maintains bars 130, 132, 134, 136 and 138 as horizontal relative to sight block 50 and parallel to each other. However, because the linkage arms are of different lengths, the respective vertical heights $H_1$, $H_2$, $H_3$ and $H_4$ will change relative to each other. The relationship of the height changes is controlled by and proportional to the respective length differences of the linkage arms.

By selecting specific linkage arm lengths, the aggregate heights can be controlled so that they match the proportional height relationships governed by the range formula. For example, sight point axis $P_1$ defines a first pin height at a reference or zero height, sight point axis $P_2$ defines a second pin height at height $H_1$, sight point axis $P_3$ defines a third pin height at height $H_1+H_2$, sight point axis $P_4$ defines a fourth pin height at height $H_1+H_2+H_3$, and sight point axis $P_5$ defines a fifth pin height at height $H_1+H_2+H_3+H_4$. Alternately, the respective sight point axes can be measured along an upper edge $P_1$", a lower edge P", or any other parallel line on bars 130, 132, 134, 136 & 138.

When mechanism 110 is mounted to sight body 20, the sight point axis of each horizontal bar defines a height indicating a reference point where a corresponding sight pin should be mounted and secured. The reference point may be an edge of the bar, or it may be a specific line defined on the bar such as an inscribed line or a taut horizontal wire extending across slot 136. Alternately, the reference point can be a single point such as the pivot axis of a pivot pin 143. For example as illustrated from an internal perspective in FIG. 6, the sight point base can be aligned along a sight point axis wherever the horizontal bars or pivot points are visible in either track 52 or track 54. Optionally, each horizontal reference bar can be labeled, for example with numbers or colors to indicate a specific corresponding distance to clearly designate which bar is the "20" yard bar, which is the "30" yard bar, which is the "40" yard bar, etc.

Optionally, a single planar relationship of sight pins within the sight guard is desired to maintain a constant distance from the archer's eye to each of the respective sight points. The base of each sight pin can be aligned in a forward or rearward track 52 or 54 as desired to accommodate the base at the height of an indicated sight point axis while allowing multiple pins to be mounted to the sight block 50. In this example, optionally one or more pins are offset, for example by being curved forward or rearward along their length to compensate for the separation between tracks 52 and 54. In alternate embodiments, one or more of the tracks may be angled so that the sight pins extend inward in a manner to arrange the sight points along a common line at a constant distance from the archer's eye to each of the respective sight points As an example of use with mechanism 110 mounted to or incorporated within sight 10 which is mounted to a bow, the bow is shot at a fixed target at 20 yards and mechanism 110 is adjusted so that the height of horizontal bar 130 and axis $P_1$ along with a first sight pin are calibrated and optionally locked in place, for example with a clamp so that an arrow strikes the yard target point when the first sight pin is used. Mechanism 110 and a first sight pin can be adjusted by adjusting the entire sight block 50 relative to bow 10 or by adjusting the mounting of mechanism 110 and the first sight pin relative to sight block 50. The bow is then shot at a fixed target point at 60 yards, and mechanism 110 is expanded or contracted relative to bar 130 so that the height of a 60 yard bar, such as horizontal bar 138 and axis $P_5$ along with a second sight pin are calibrated so that an arrow strikes the 60 yard target point when the second sight pin is used. Thereafter, third, fourth and fifth pins, for example corresponding to 30, 40 and 50 yard target ranges, can be adjusted in height to match the height of axes $P_2$, $P_3$ and $P_4$.

The mechanism is described in this example as adjusted concurrently with adjusting the first and fifth sight pins. Alternately, the mechanism can be mounted and independently adjusted to match the height of the first and fifth sight pins after one or both pin heights have been established.

Illustrated in FIGS. 7-11 are two embodiments which can be used as tools and can be selectively mounted to a sight to assist in aligning sight pins. Adjustment mechanism 240 can be mounted to sight block 250 adjacent the bases 222 of the sight pins 220. Adjustment mechanism 340 can be mounted to sight guard 314 adjacent the sight points of sight pins 320.

Figure 7:
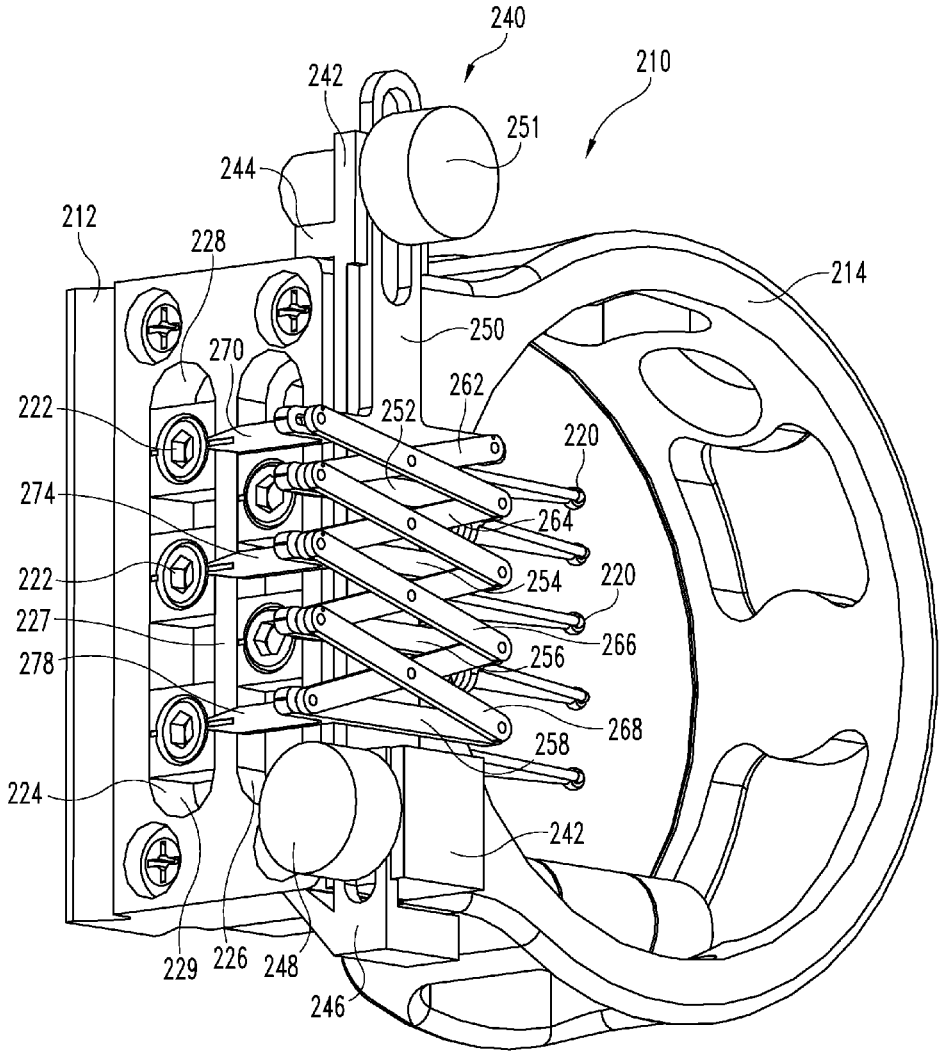
FIG. 7 is a perspective view of a sight assembly according to an alternate embodiment.
Figure 8:
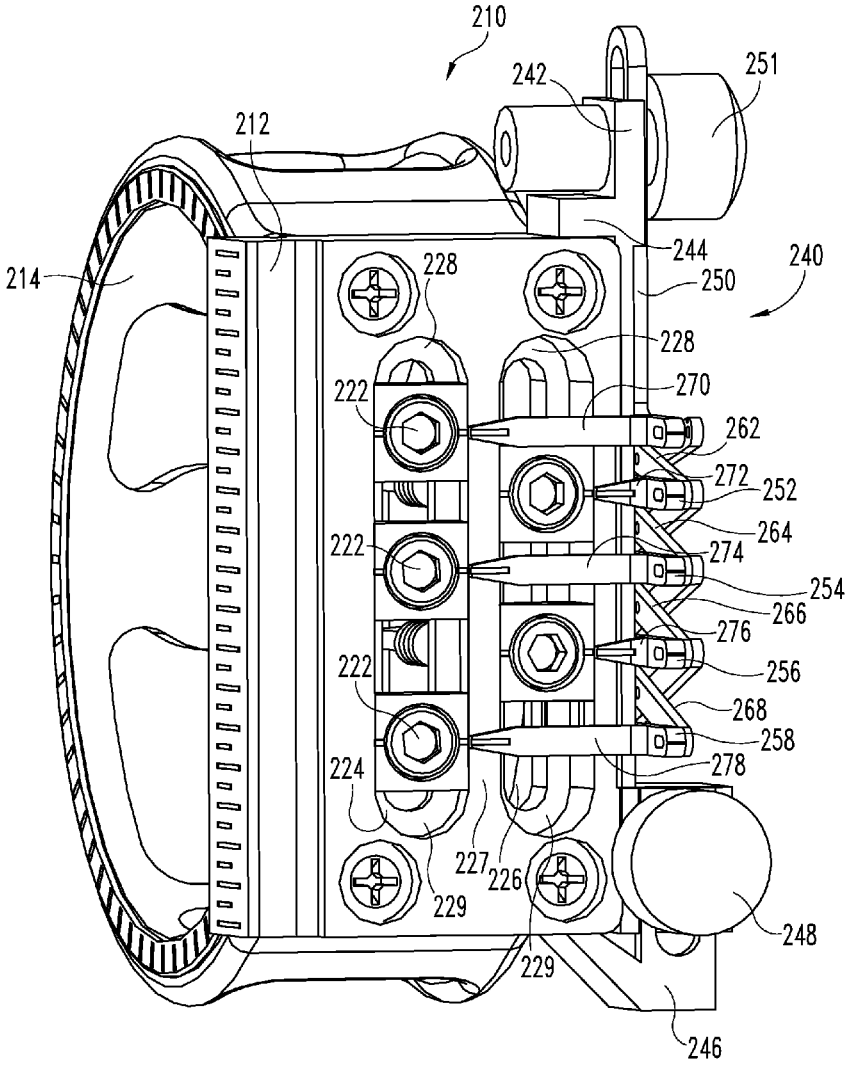
FIG. 8 is an alternate perspective view of the sight assembly of FIG. 8.
Figure 9:
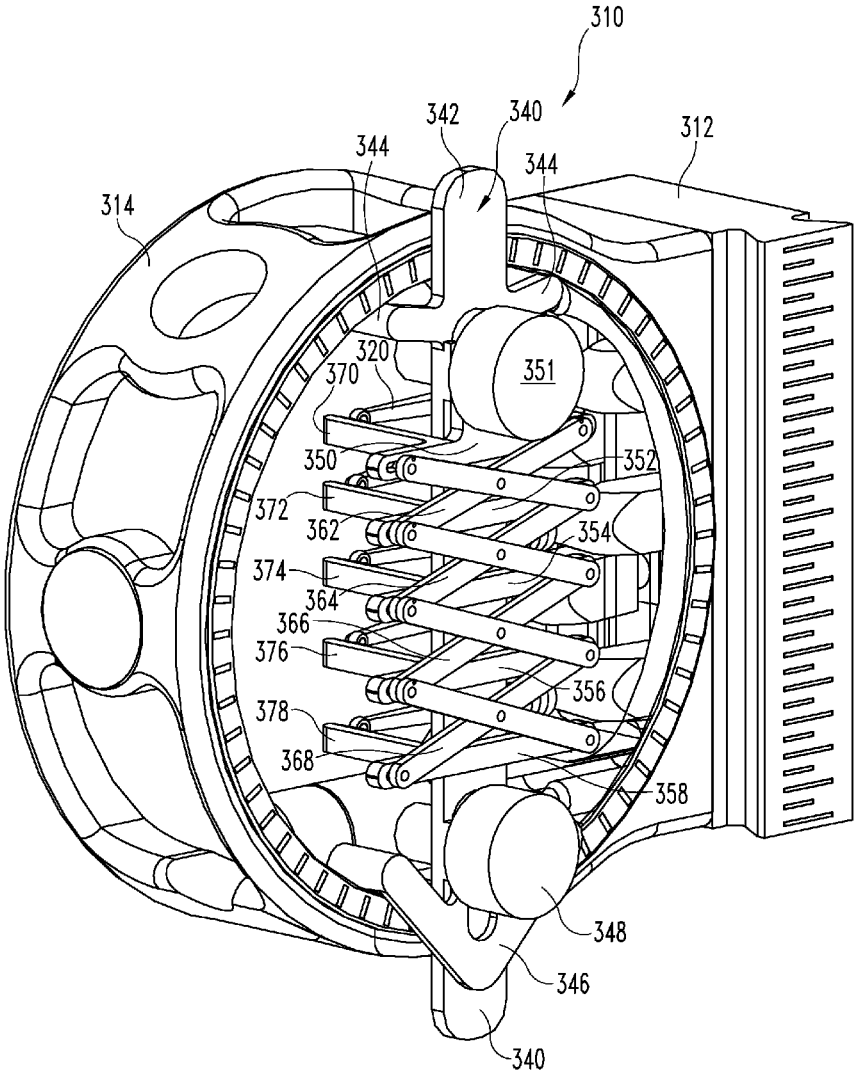
FIG. 9 is a perspective view of a sight assembly according to an alternate embodiment.

Sight assembly 210 is illustrated in FIGS. 7-9. Sight assembly 210 includes sight block 212 from which extends sight guard 214. Sight pins 220 have bases 222 selectively secured to sight block 212, for example with clamps and screws, and sight pins 220 extend into sight guard 214. The bases 222 of sight pins 220 are mounted in one of tracks 224 or 226, separated by central pillar 227. The sight pins are mounted between the upper ends 228 and lower ends 229 of the tracks.

Adjustment mechanism 240 is mounted to sight assembly 210 in FIGS. 7-9. Adjustment mechanism 240 includes a vertical base bar 242 having an upper tab 244 engaging the top of sight block 212. A lower clamp portion 246 is adjustably mounted to the lower end of base bar 242. Lower clamp portion 246 has a tab portion which engages the bottom of sight block 212. Base bar 242 and lower clamp 246 can be pressed together to grasp the sight block 212 between upper tab 244 and lower clamp portion 246. Clamp screw 248 can then be tightened to lock lower clamp portion 246 to base bar 242, thereby securing adjustment mechanism 240 to sight assembly 210.

Adjustment mechanism 240 includes a linkage arrangement, similar to the arrangement illustrated in FIG. 3, adjustably mounted to base bar 242. In the illustrated example, upper alignment bar 250 is formed in an upside down "T" shape with an upper leg having a slot engaged by locking screw 251, which is mounted to base bar 242. Alignment bar 250 is slidably adjustable relative to base bar 242 when locking screw 251 is loose, and can be selectively locked in place relative to base bar 242 by tightening locking screw 251.

Extending downward from upper alignment bar 250 is a first pair of linkage arms 262. The upper pivot end points of linkage arms 262 are rotatably and slidably mounted to short slots in bar 250. The lower pivot end points of linkage arms 262 are rotatably and slidably mounted to a second horizontal bar 252 such as in short slots, and form shared pivot points with the upper ends of the next pair of linkage arms 264. Similarly, the lower pivot end points of each pair of linkage arms 264 and 266 are rotatably and slidably mounted to horizontal bars 254 and 256 respectively, which form shared pivot points with the upper ends of the next pair of linkage arms 266 and 268 respectively. The lower pivot end points of the lowest pair of linkage arms 268 are rotatably and slidably mounted in the lowest horizontal arm 258.

Integrated with or mounted to each of horizontal alignment bars 250, 252, 254, 256 and 258 is a pointer arm 270, 272, 274, 276 and 278 respectively. Each pointer arm extends along the sight block to a reference point adjacent either track 224 or 226. Each reference point preferably designates the height along the track where the base 222 of a corresponding sight pin 220 should be aligned. Optionally, the pointer arm and/or the sight pin base includes indicia such as a marking or etched line and/or a yardage number or color to assist in precise alignment of a sight pin to a desired height.

The linkage arrangement can be expanded or contracted along the height of base bar 242 and relative to first alignment bar 250. Adjustment can be done manually, for example by grasping part of the linkage and urging it upward or downward. Alternately, a mechanical adjustment mechanism, such as a worm gear arrangement, may be added. Adjustment mechanism 240 may be mounted to sight block 212 before, during or after the calibration of the first two sight pins, and can be removed when not in use.

A variant of sight assembly 210 includes adjustment mechanism 240 or a slightly modified version which can be used with a sight block having one pin or with a lesser number of pins than the number of pointer arms. In these embodiments, one or multiple pins can be vertically adjusted in one track or multiple tracks. The pin or pins are used to calibrate first and second reference positions. The adjustment mechanism then indicates with pointer arms the positions to which the pin or pins can be adjusted to shoot at different distances. In still alternate embodiments, an adjustment mechanism can designate reference positions relative to which a sight block assembly including a pin or pins can be adjusted.

Figure 10:
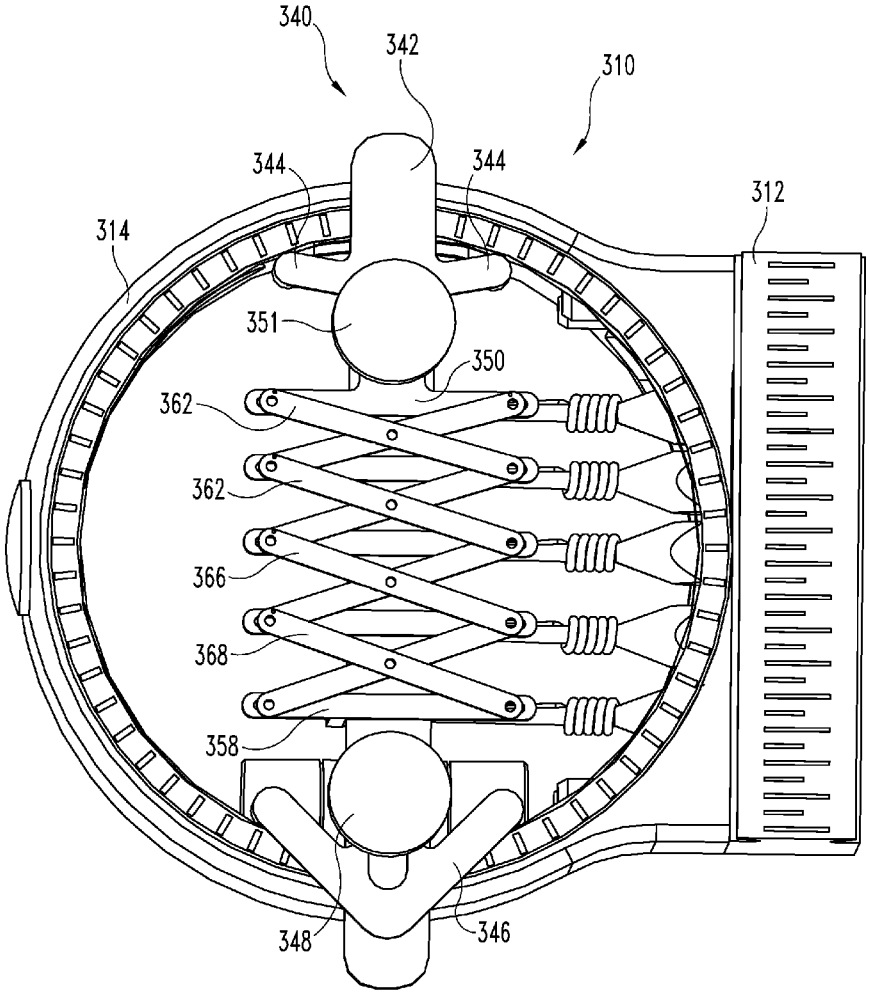
FIG. 10 is a front view of the sight assembly of FIG. 9 from the view of an archer looking into the sight assembly.
Figure 11:
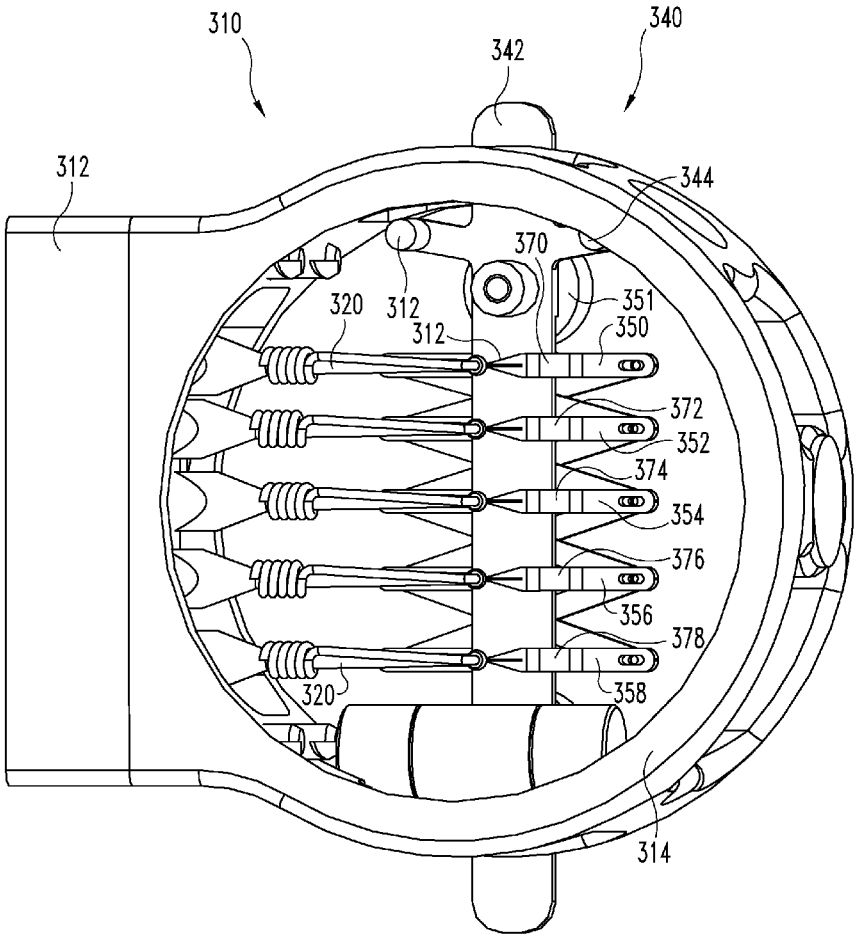
FIG. 11 is a rear view of the sight assembly of FIG. 9 from the front of the bow looking rearward.

Adjustment mechanism 340 is mounted to sight assembly 310 in FIGS. 10-11. Adjustment mechanism 340 includes a vertical base bar 342 having a pair of upper tabs 344 engaging the inner upper periphery of sight guard 314, which extends from sight block 312. A lower clamp portion 346 is adjustably mounted adjacent the lower end of base bar 342. Lower clamp portion 346 has a pair of tabs which engage the inner lower periphery of sight guard 314. Base bar 342 and lower clamp 346 can be expanded along a diameter of sight guard 314 to center the mechanism and to form an interior clamping arrangement via the upper tabs and the lower tabs pressing outward. Clamp screw 348 can then be tightened to lock lower clamp portion 346 to base bar 342, thereby securing adjustment mechanism 340 to sight assembly 310.

Adjustment mechanism 340 includes a linkage arrangement, similar to the arrangement illustrated in FIG. 3, which is adjustably mounted to base bar 342. In the illustrated example, upper alignment bar 350 is formed in a "T" shape with an upper leg having a slot engaged by locking screw 351, which is mounted to base bar 342. Alignment bar 350 is slidably adjustable relative to base bar 342 when locking screw 351 is loose, and can be selectively locked in place relative to base bar 342 by tightening locking screw 351.

Extending downward from alignment bar 350 is a first pair of linkage arms 362. The upper pivot end points of linkage arms 362 are rotatably and slidably mounted to short slots in bar 350. The lower pivot end points of linkage arms 362 are rotatably and slidably mounted to a second horizontal bar 352 such as in short slots, and form shared pivot points with the upper ends of the next pair of linkage arms 364. Similarly, the lower pivot end points of each pair of linkage arms 364 and 366 are rotatably and slidably mounted to horizontal bars 354 and 356 respectively, which form shared pivot points with the upper ends of the next pair of linkage arms 266 and 268 respectively. The lower pivot end points of the lowest pair of linkage arms 368 are rotatably and slidably mounted in the lowest horizontal arm 358.

Integrated with or mounted to each of horizontal alignment bars 350, 352, 354, 356 and 358 is a pointer arm 370, 372, 374, 376 and 378 respectively. Each pointer arm extends to a point adjacent a desired sight point location for one of sight pins 320. Each pointer arm preferably designates the height where the sight point of a corresponding sight pin 320 is or should be aligned. Optionally, the pointer arm includes indicia such as a marking or etched line and/or yardage numbers or colors to assist in precise alignment of the sight point to a desired height.

The linkage arrangement can be expanded or contracted along the height of base bar 342 and relative to first alignment bar 350. Adjustment can be done manually, for example by grasping part of the linkage and urging it upward or downward. Alternately, a mechanical adjustment mechanism, such as a worm gear arrangement, may be added.

Adjustment mechanism 340 is typically not mounted to sight guard 314 while first and second reference sight pins are aligned. Typically, mechanism 340 is mounted to the guard after the first two pins are aligned and is then expanded or contracted to align the corresponding pointer arms with the calibrated pins. Thereupon, the remaining pointer arms designate heights for the remaining sight pins. Mechanism 340 is typically removed when not in use.

FIGS. 12-15 illustrate a bow sight assembly 410 with an integrated adjustment mechanism 440. Sight assembly 410 includes a rearward base portion 416, to which a sight body assembly 418 may be selectively vertically and horizontally mounted. Sight body assembly 418 includes a sight block 412 and a sight guard 414.

Figure 12:
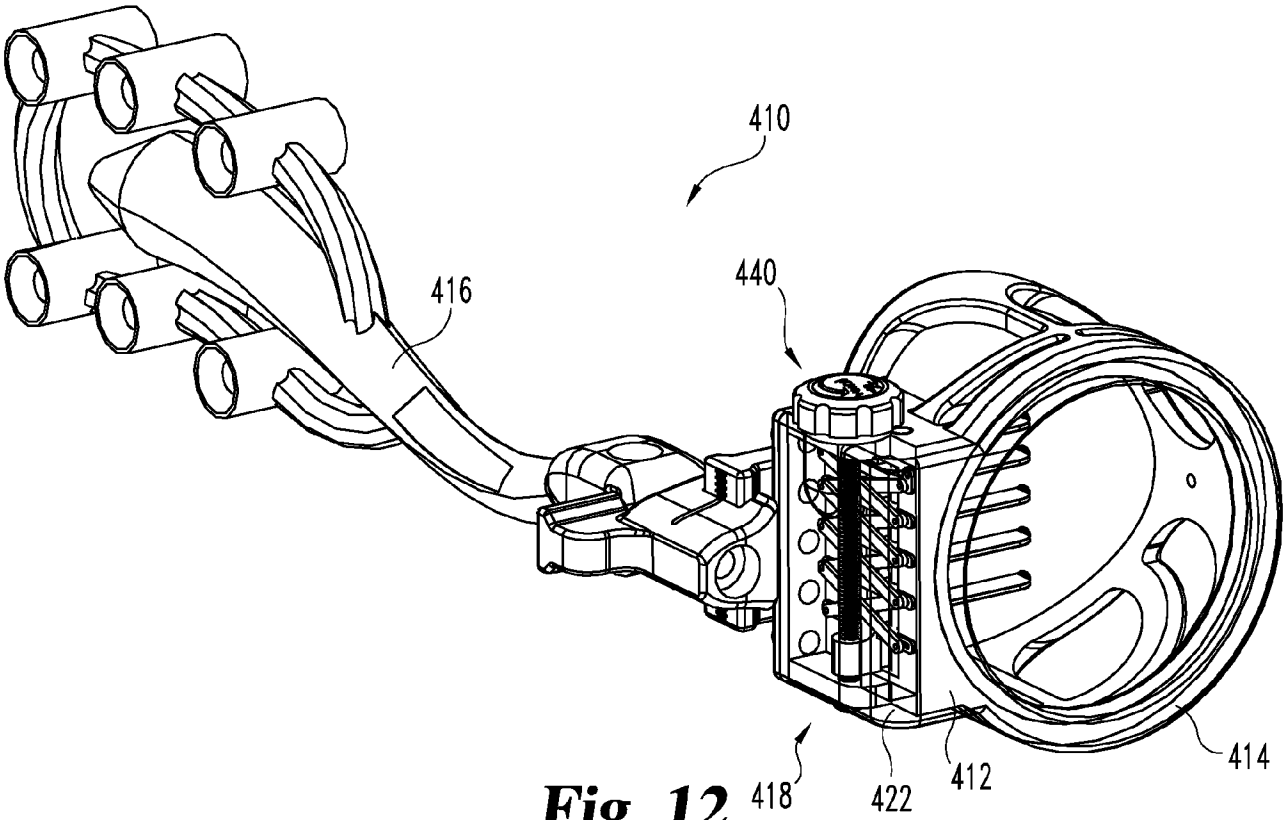
FIG. 12 is a perspective view of a sight assembly according to an alternate embodiment.
Figure 13:
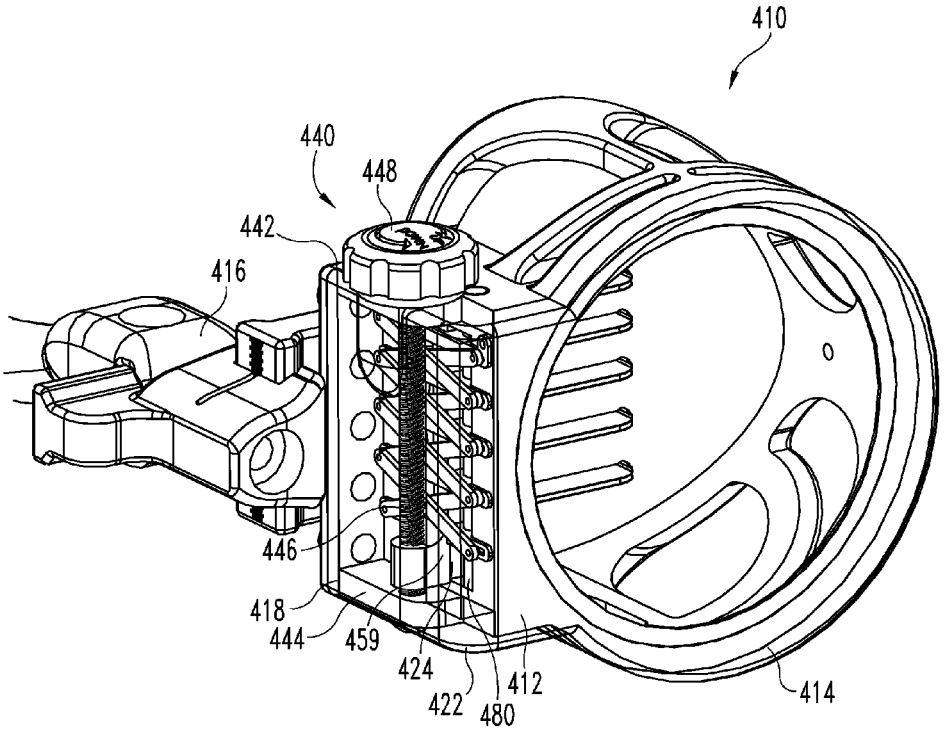
FIG. 13 is an enlarged, perspective view of a portion of the sight assembly of FIG. 13.
Figure 14:
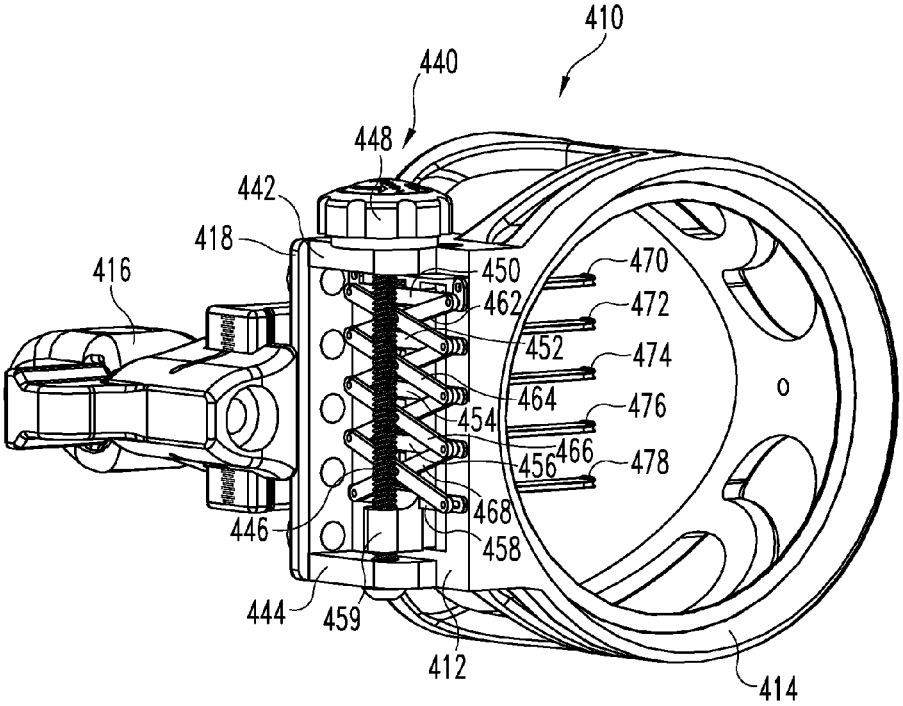
FIG. 14 is a detailed view of the portion of the sight assembly of FIG. 13 with the transparent cover not illustrated.
Figure 15:
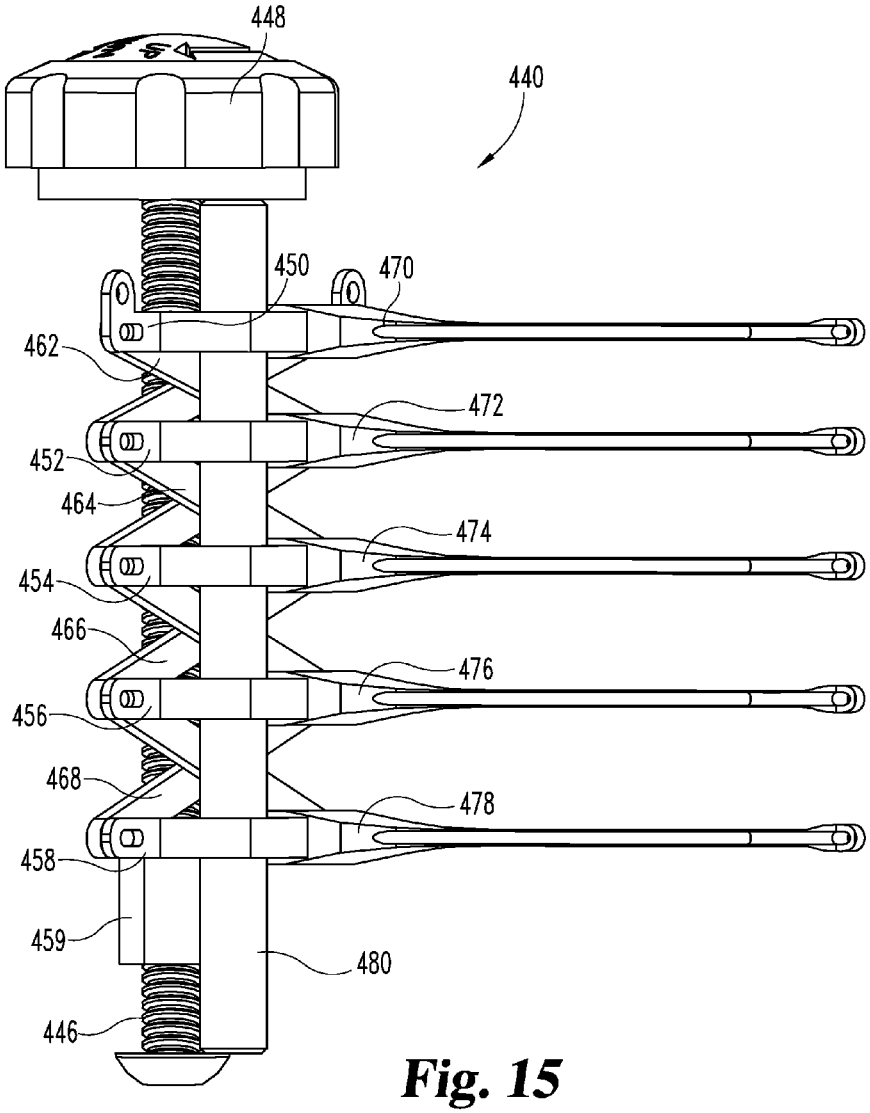
FIG. 15 is a detailed view of the adjustment mechanism of FIG. 14.

Adjustment mechanism 440 is mounted to sight block 412. Mechanism 440 includes a worm gear or continuous screw 446 arrangement extending between an upper mount 442 on the sight block and a lower mount 444 on the sight block. Worm gear 446 may be rotated clockwise or counter-clockwise using an adjustment mechanism, such as knob 448. The ends of the worm gear 446 preferably rotate within the upper and lower mounts 442 and 444 without displacing the gear shaft. In certain embodiments, adjustment mechanism 440 is enclosed within a cover 422, which optionally may be transparent or opaque. Cover 422 may also extend over the front of guard 414 to enclose fiber optic strands leading to the pins. Cover 422 is illustrated as a transparent cover in FIGS. 12 and 13, and is not illustrated in FIG. 14 for clarity. The adjustment mechanism of FIGS. 12-14 is illustrated separately from the overall sight assembly in FIG. 15 for reference.

Sight assembly 440 includes a linkage arrangement similar to the arrangement illustrated in FIG. 3, adjustably mounted between the sight block 412 and worm gear 446. In the illustrated example, upper alignment bar 450 is secured adjacent an upper end of track 424 defined through sight block 412 to sight guard 414. Extending downward from alignment bar 450 is a first pair of linkage arms 462. The upper pivot end points of linkage arms 462 are rotatably and slidably mounted to short slots in bar 450. The lower pivot end points of linkage arms 462 are rotatably and slidably mounted to a second horizontal bar 452 such as within slots, and form shared pivot points with the upper ends of the next pair of linkage arms 464. Similarly, the lower pivot end points of each pair of linkage arms 464 and 466 are rotatably and slidably mounted to horizontal bars 454 and 456 respectively, which form shared pivot points with the upper ends of the next pair of linkage arms 466 and 468 respectively. The lower pivot end points of the lowest pair of linkage arms 468 are rotatably and slidably mounted in the lowest horizontal bar 458.

Integrated with or mounted to each of horizontal alignment bars 450, 452, 454, 456 and 458 is a sight pin 470, 472, 474, 476 and 478 respectively. Each sight pin extends through track 424 into sight guard 414 and defines a sight point at the inward end. Optionally, a vertical alignment dowel 480 may be arranged parallel to the worm gear 446 and slidably engages a passage in each sight pin such that each sight pin is maintained in alignment due to the respective alignment of the worm gear 446 and the alignment dowel 480. Vertical adjustment of each of horizontal alignment bars 450, 452, 454, 456 and 458 correspondingly adjusts the height of a sight pin 470, 472, 474, 476 and 478 respectively.

The lowest horizontal bar 458 includes a worm gear mount 459 which is in threaded engagement with worm gear 446. Worm gear mount 459 travels upward or downward corresponding to rotation of worm gear 444, and correspondingly raises or lowers the lowest horizontal bar 458. In alternate embodiments, the worm gear mount may be mounted to other horizontal bars or an alternate adjustment mechanism may be used. The linkage arrangement can be expanded or contracted along the height of sight block 412 and relative to first alignment bar 450 by rotating worm gear 444 in a clockwise or counter-clockwise direction to move bar 458.

In use, sight block 412 is adjusted to calibrate a first sight pin to a first distance. Then, during calibration the adjustment mechanism is used to adjust a second pin to a second distance. After correctly aligning the first and second pins, the remaining pins will already be adjusted to corresponding distances.

Illustrated in FIGS. 16-19 are two embodiments which can be used to selectively adjust archery sights using vertical pins. In the illustrated embodiments, an adjustment mechanism can be mounted to a sight block to proportionally move the height of selected sight pins. In the illustrated embodiments, the sight pin for the closest distance is mounted uppermost, with the remainder of the sight pins extending downward to differing heights.

Figure 16:
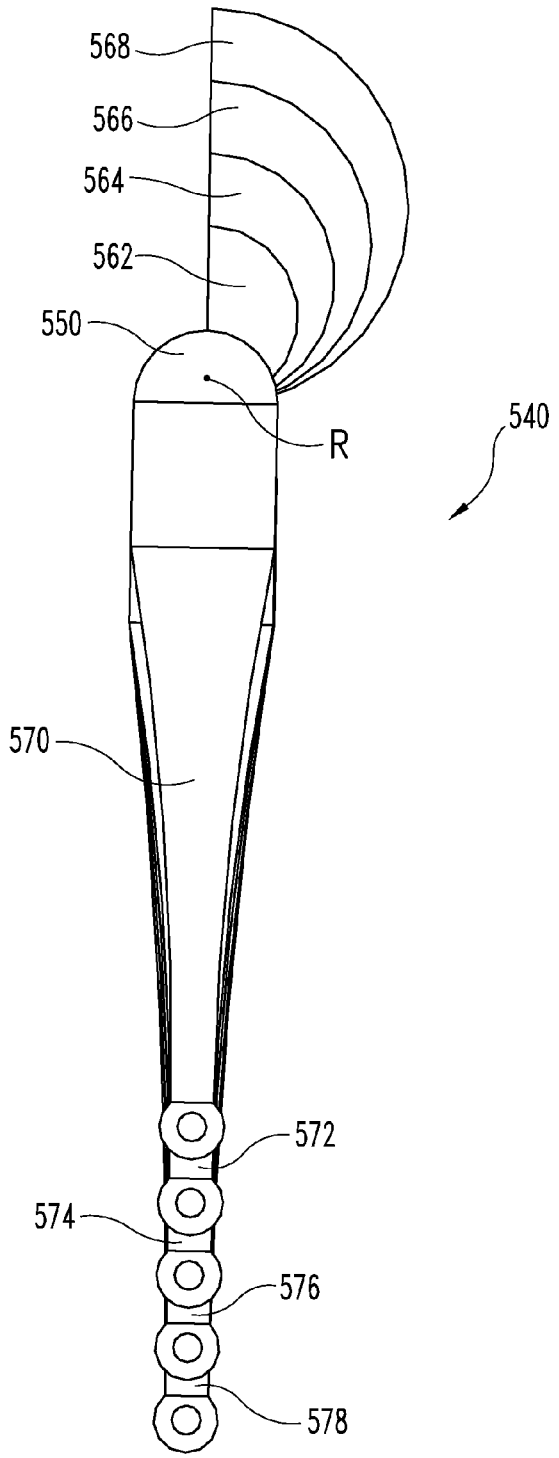
FIG. 16 is a front schematic view of an adjustment mechanism for vertical pins in a sight assembly according to an alternate embodiment.
Figure 17:
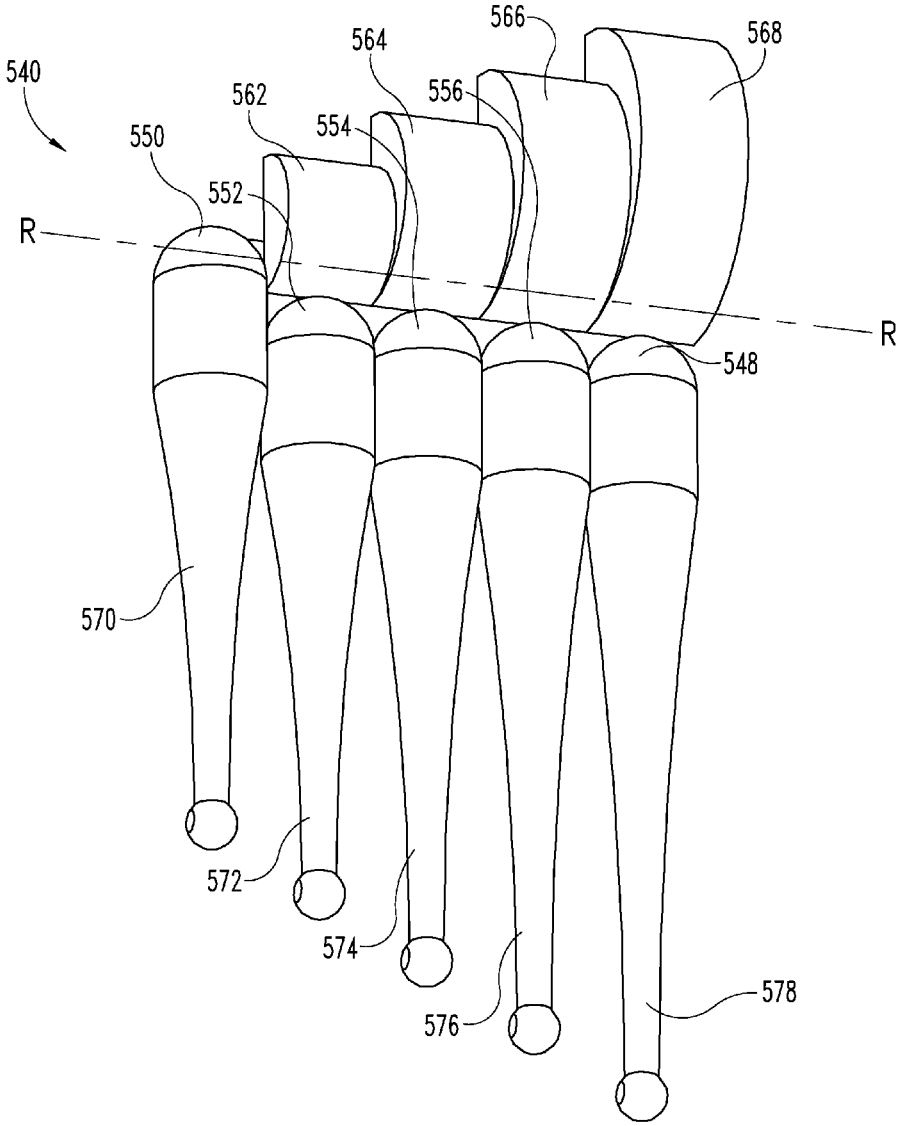
FIG. 17 is a perspective view of the adjustment mechanism of FIG. 16.

FIGS. 16-17 schematically illustrate vertical pin adjustment assembly 540. Assembly 540 includes vertical sight pins 570, 572, 574, 576 and 578. The sight pins have bases 550, 552, 554, 556 and 558 respectively. In the illustrated embodiment, sight pin 570 is the pin closest to the archer. The base 550 of sight pin 570 is mounted at a fixed height relative to adjustment assembly 540 and the sight guard (not shown), and can be vertically adjusted by adjusting the entire assembly and sight guard. The pins 572, 574, 576 and 578 are mounted to slide vertically relative to pin 570. In the illustrated embodiment, the adjustment mechanism incorporates eccentric cam portions 562, 564, 566 and 568 which may be integral in one piece or separate portions sharing a common rotational axis R. The cam portions are eccentrically mounted to the same horizontal axis R and have shaped radii such that rotation of the adjustment mechanism rotates the cam portions and corresponding vertically adjusts bases 552, 554, 556 and 558 to respective proportional heights.

In use, the sight is adjusted so that first pin 550 is calibrated to a first distance. The adjustment mechanism is used to adjust a second pin to a second distance. After correctly aligning the first and second pins, the remaining pins will already be adjusted to corresponding distances.

Figure 18:
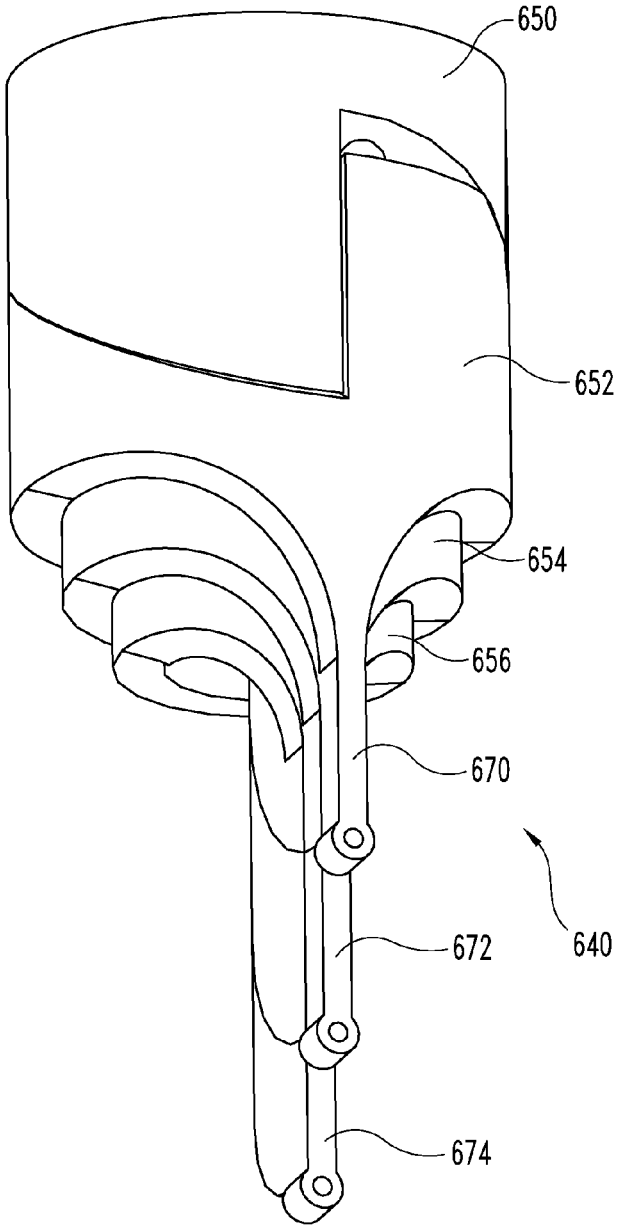
FIG. 18 is a perspective view of an adjustment mechanism for vertical pins in a sight assembly according to an alternate embodiment.
Figure 19:
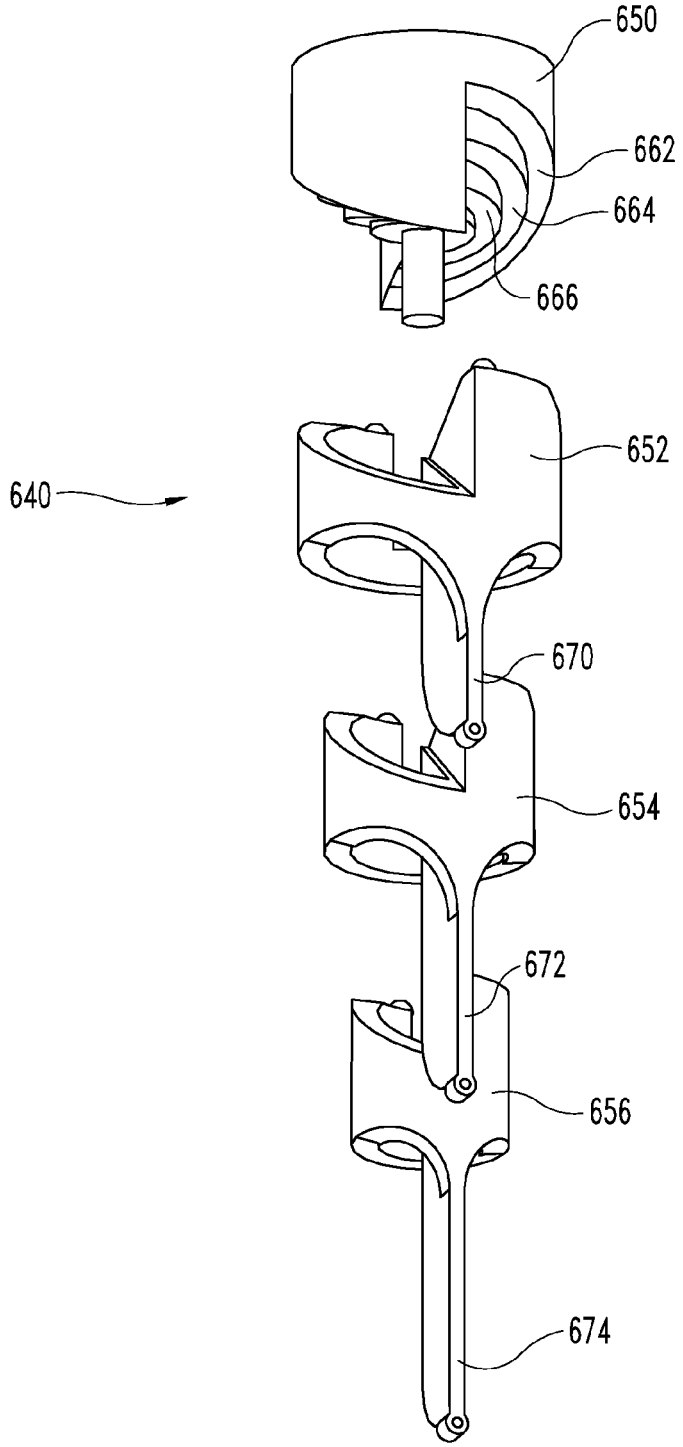
FIG. 19 is an exploded view of the adjustment mechanism of FIG. 18.

FIGS. 18-19 schematically illustrate an alternate vertical pin adjustment assembly 640. Assembly 640 includes vertical sight pins 670, 672 and 674. The sight pins are nested within each other and mounted on base 650. Base 650 defines spirally curved tracks 662, 664 and 666 which receive complimentary shaped tracks on the lower edges of pin bases 652, 654 and 656. Pins 670, 672 and 674 are inhibited from rotational movement while base 650 can rotate relative to the pins. Rotation of base 650 around a vertical axis causes the height of pins 670, 672 and 674 to change corresponding to the slope and curvature of the spiral track portions. For pin 670, closest to the archer, rotation of base 650 may maintain a certain height. The slope and curvature of the spiral track portions is preferably calculated to maintain the desired proportional spacing of the respective pin heights. Three sight pins are illustrated for ease of reference, but additional pins can be incorporated in the pattern with corresponding alterations to base 650 and the respective tracks.

In use, the sight is adjusted so that first pin 650 is calibrated to a first distance. The adjustment mechanism is used to adjust a second pin to a second distance. After correctly aligning the first and second pins, the remaining pins will already be adjusted to corresponding distances.

Figure 20:
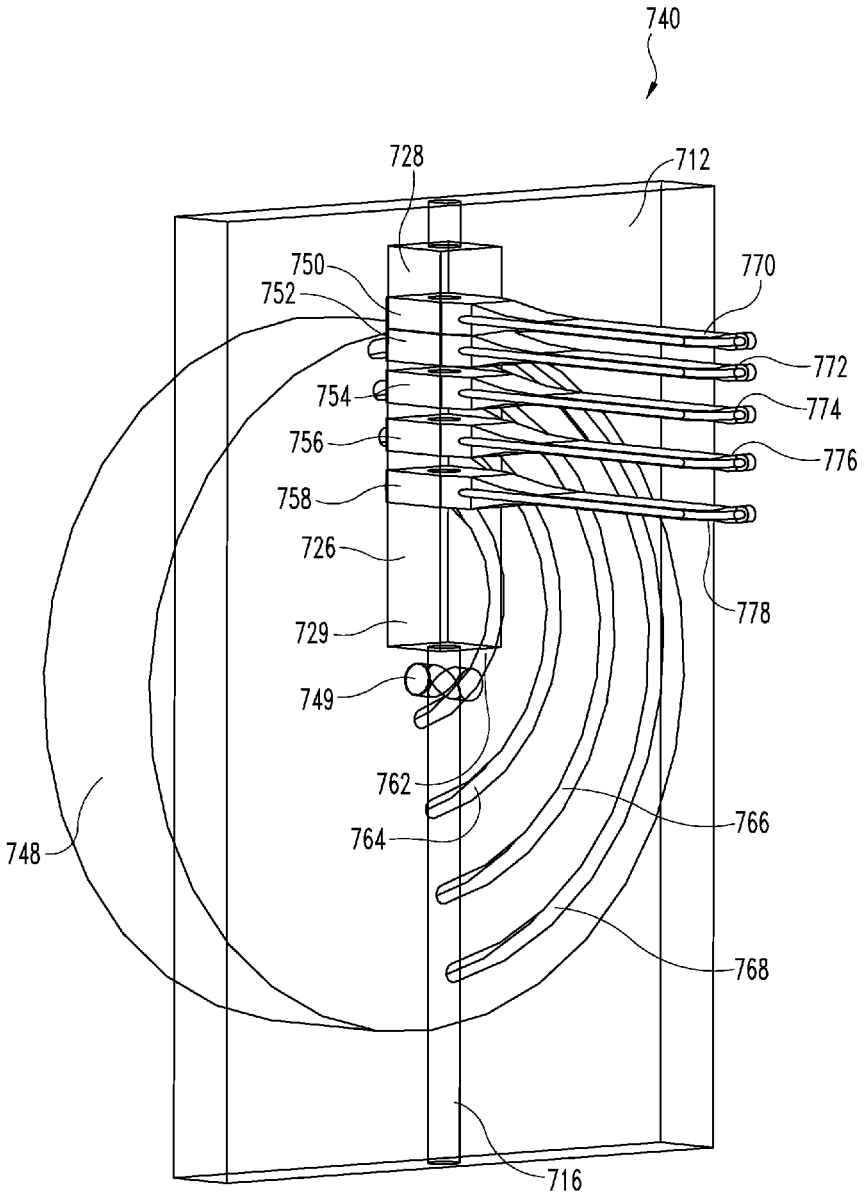
FIG. 20 is a perspective schematic view of an adjustment mechanism for horizontal pins in a sight assembly according to an alternate embodiment.
Figure 21:
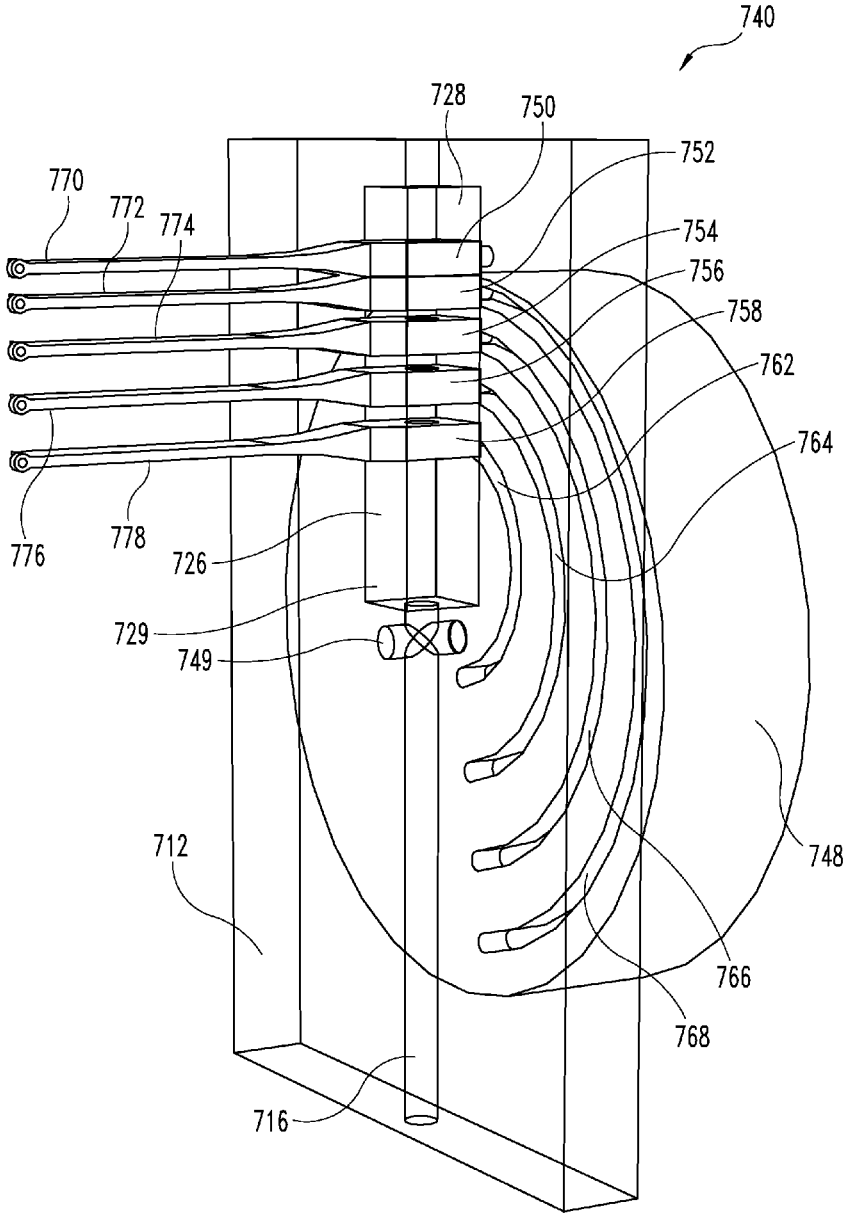
FIG. 21 is an alternate perspective view of the adjustment mechanism of FIG. 20.

FIGS. 20-21 illustrate an alternate horizontal pin adjustment assembly 740. Assembly 740 includes horizontal sight pins 770, 772, 774, 776 and 778. The respective bases 750, 752, 754, 756 and 758 of the sight pins are mounted within slot 726 in a sight block 712 (represented schematically). Slot 726 defines upper end 728 and lower end 729. Sight block 712 is illustrated as transparent for illustration purposes. Optionally, the upper sight pin 770 has a base 750 mounted at a fixed height relative to sight block 712 adjacent upper end 728 of slot 726. Bases 752, 754, 756 and 758 of the remaining pins are slidably mounted within slot 726 below base 750. Bases 752, 754, 756 and 758 also engage vertical adjustment wheel 748 mounted along horizontal axis 729. Optionally a vertical dowel rod (not shown) may extend the length of block 712 within slot 716 to slidably engage a passage in each sight pin such that each sight pin is retained and maintained in alignment.

Wheel 748 defines spirally curved and eccentrically positioned curved track portions 762, 764, 766 and 768 which slidably engage bases 752, 754, 756 and 758, such that rotation of wheel 748 clockwise or counter-clockwise causes pins 772, 774, 776 and 778 to adjust to respective heights within slot 726 as determined by the curve of tracks 762, 764, 766 and 768. In the illustrated embodiment the height of pin 750 remains fixed during rotation of wheel 748. In alternate embodiments, a middle or lower pin can remain fixed in height, with the curvature and positioning of the track portions arranged relative to the height of the fixed pin. For example, middle pin 774 could be arranged at a fixed height either as directly connected to block 712 or with a base engaged in a circular track portions. Other track portions would then increase or decrease the positions of pins 770, 772, 776 and 778 relative to pin 774 when the wheel is rotated.

The engagement of the pins to the track portions may be direct such as a tab-in-slot engagement, or alternately may include using a ball bearing arrangement, using low-friction materials such as Delrin® plastic or using a similar structure to facilitate sliding and movement of the bases relative to wheel 748 and slot 726. The position and curvature of the track portions is preferably calculated to maintain the desired proportional spacing of the respective pin heights as the pins are adjusted. The circumference of wheel 748 may optionally include texturing to enhance as user's grip and to allow precise adjustment and/or may include indicia such as lines or numbers to facilitate adjustment relative to indicia on sight block 712 or elsewhere on the assembly.

In use, the sight is adjusted so that first pin 750, or a fixed pin in alternate embodiments, is calibrated to a first distance. The adjustment mechanism is used to adjust a second pin to a second distance. After correctly aligning the first and second pins, the remaining pins will already be adjusted to corresponding distances.

FIGS. 22-25 illustrate a bow sight assembly 810 with an integrated adjustment mechanism 840. Sight assembly 810 includes a rearward base portion 816, to which a sight body assembly 818 may be selectively vertically and horizontally mounted. Sight body assembly 818 includes a sight block 812 and a sight guard 814.

Figure 22:
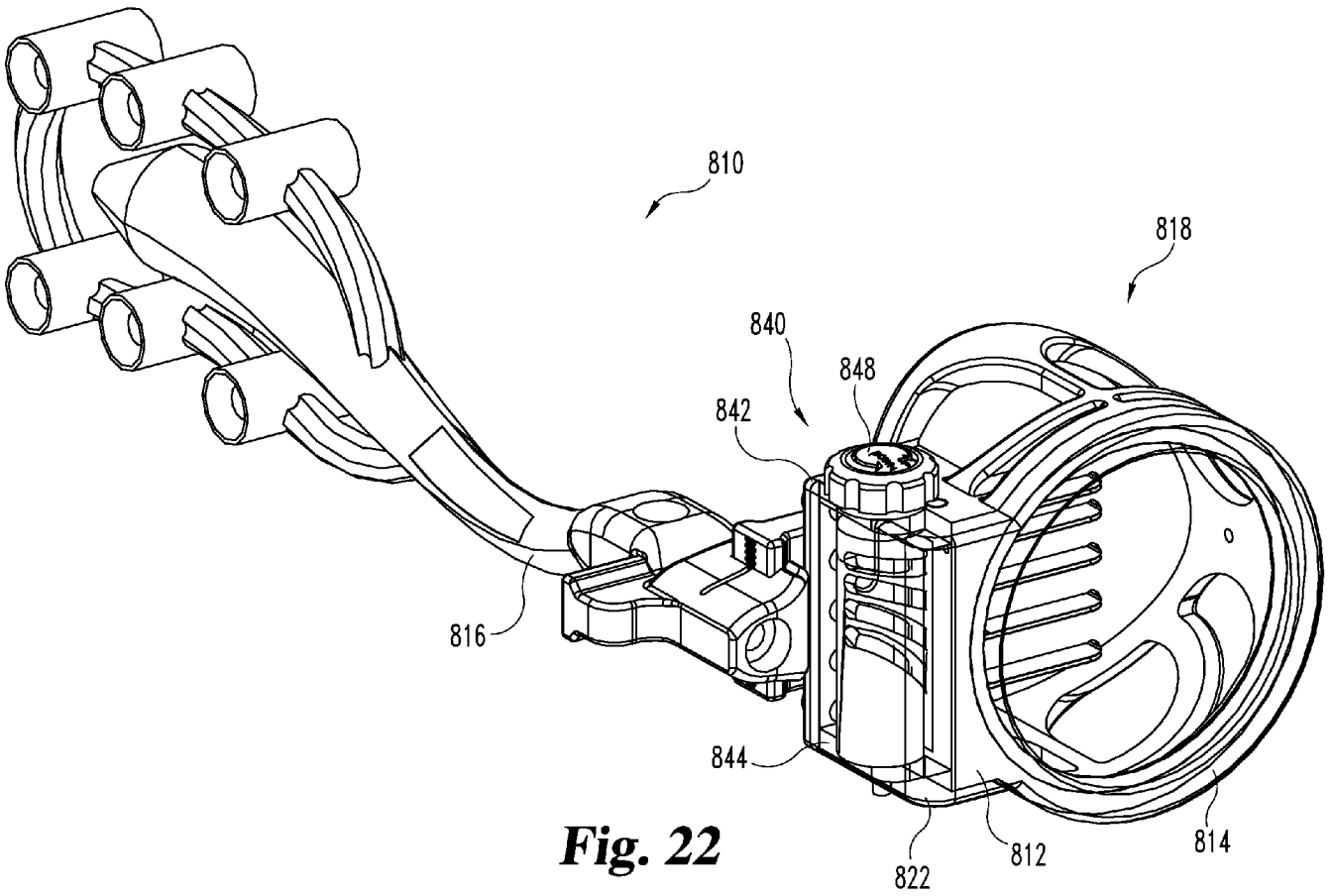
FIG. 22 is a front perspective view of a sight assembly according to an alternate embodiment.
Figure 23:
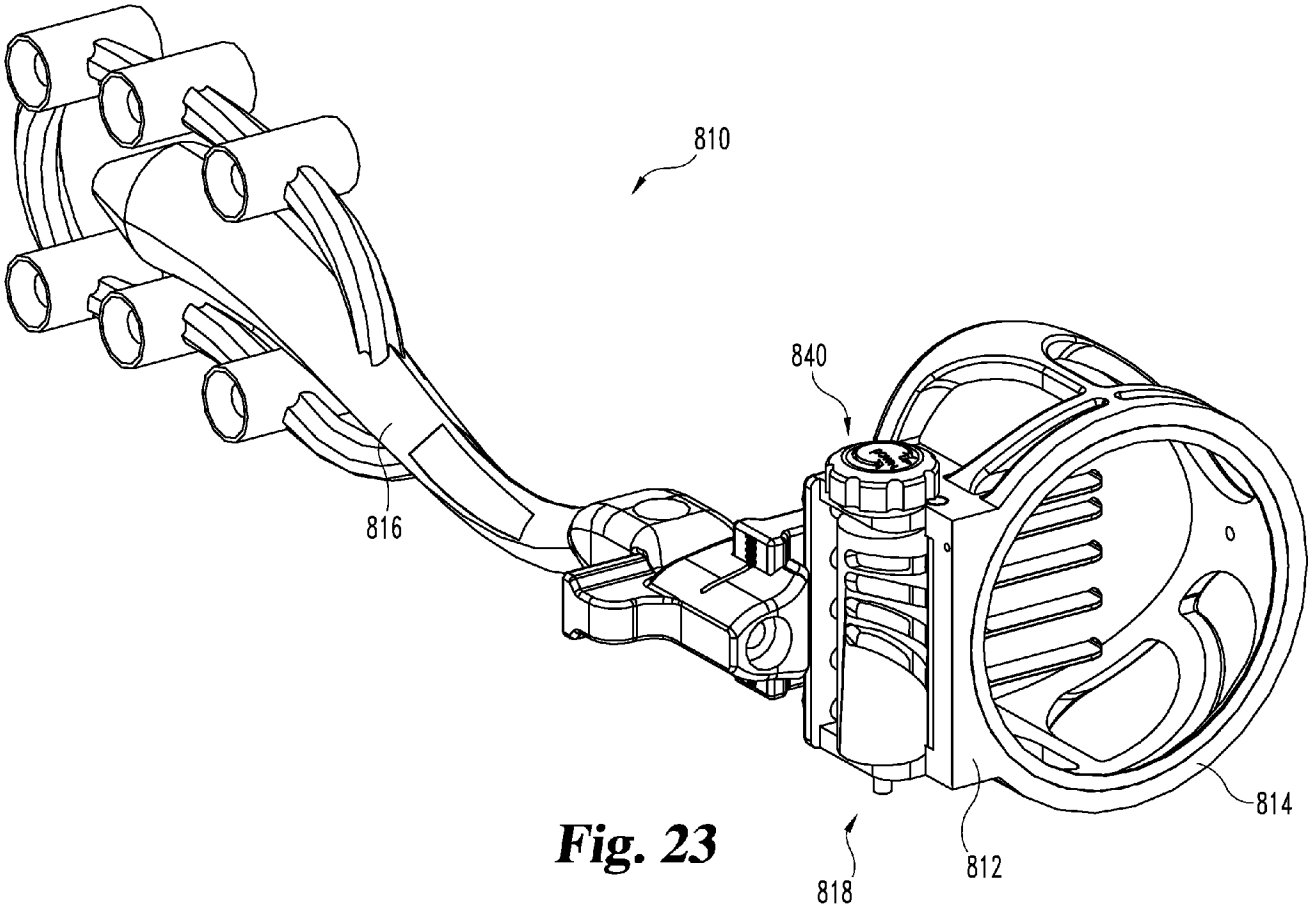
FIG. 23 is a perspective view of the sight assembly of FIG. 22 with the transparent cover not illustrated.
Figure 24:
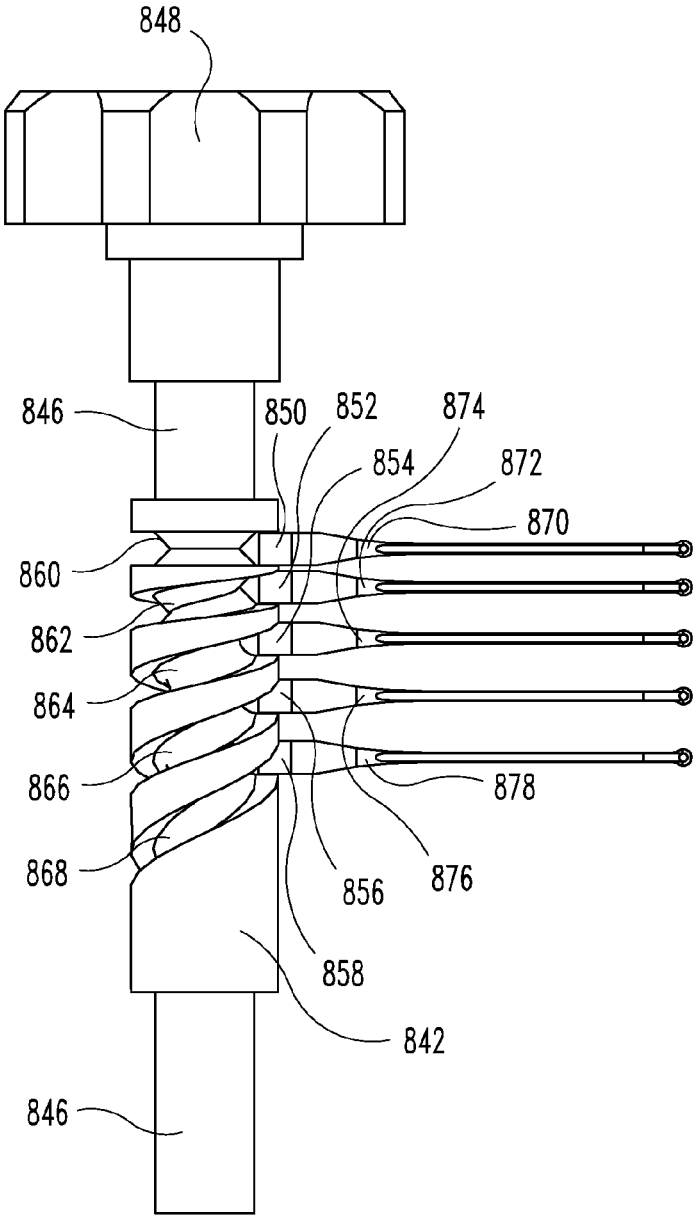
FIG. 24 is a detailed view of the adjustment mechanism of FIG. 22.
Figure 25:
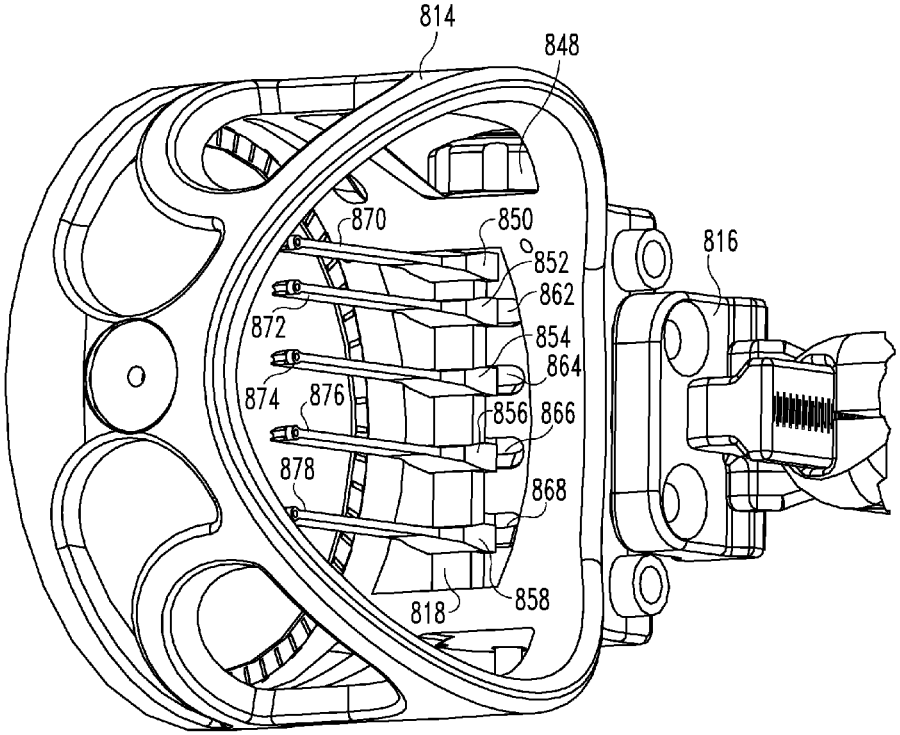
FIG. 25 is a rearward view looking into the sight assembly of FIG. 22.
Figure 26:
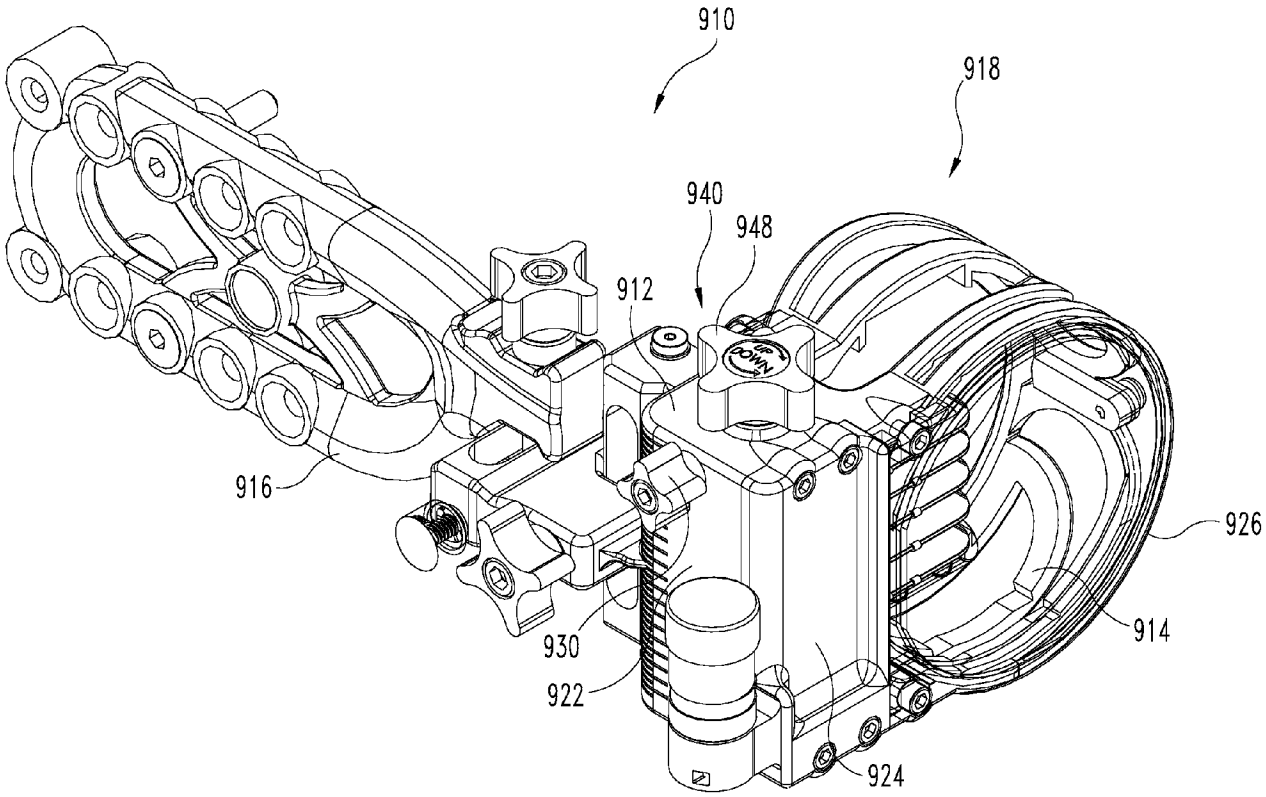
FIG. 26 is a front perspective view of a sight assembly according to an alternate embodiment.
Figure 27:
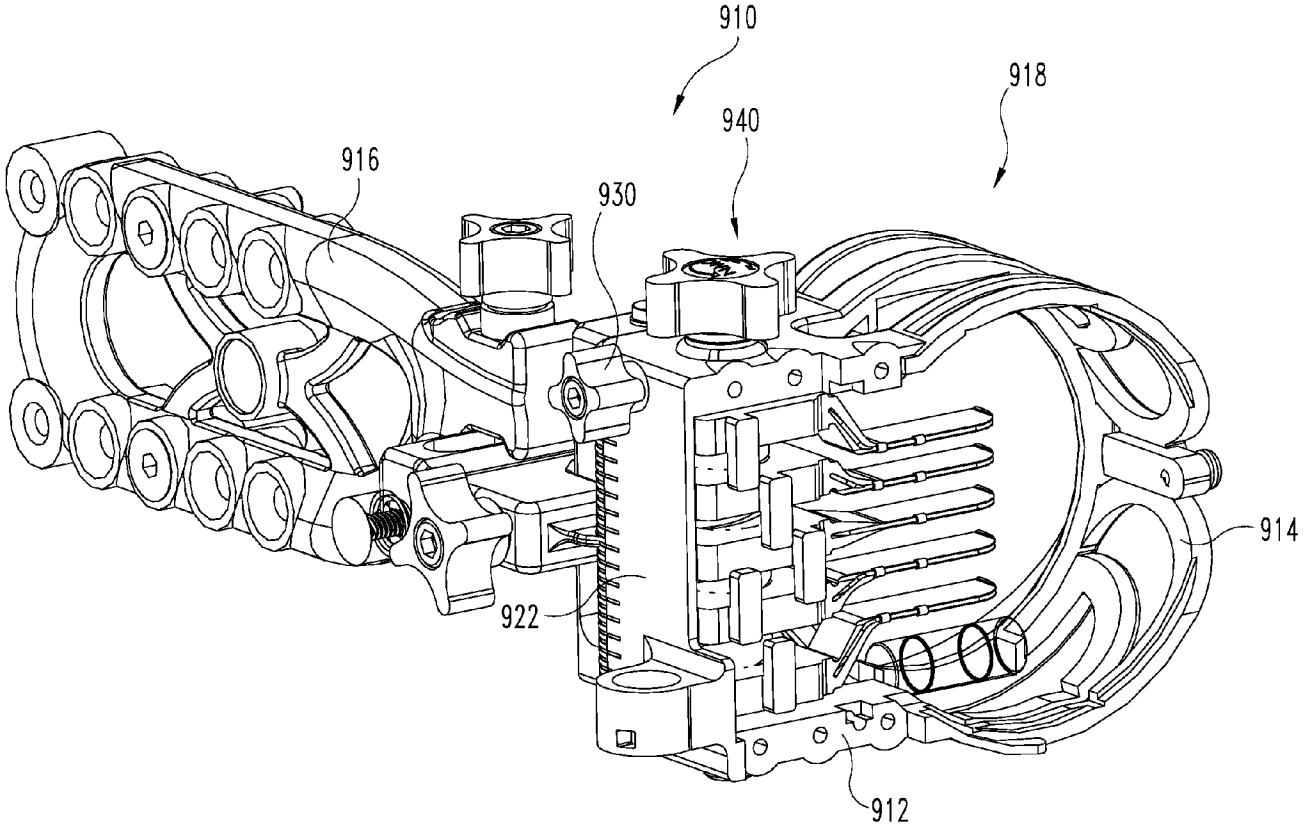
FIG. 27 is a perspective view of the sight assembly of FIG. 26 with the front cover and the transparent fiber cover not illustrated.
Figure 28:
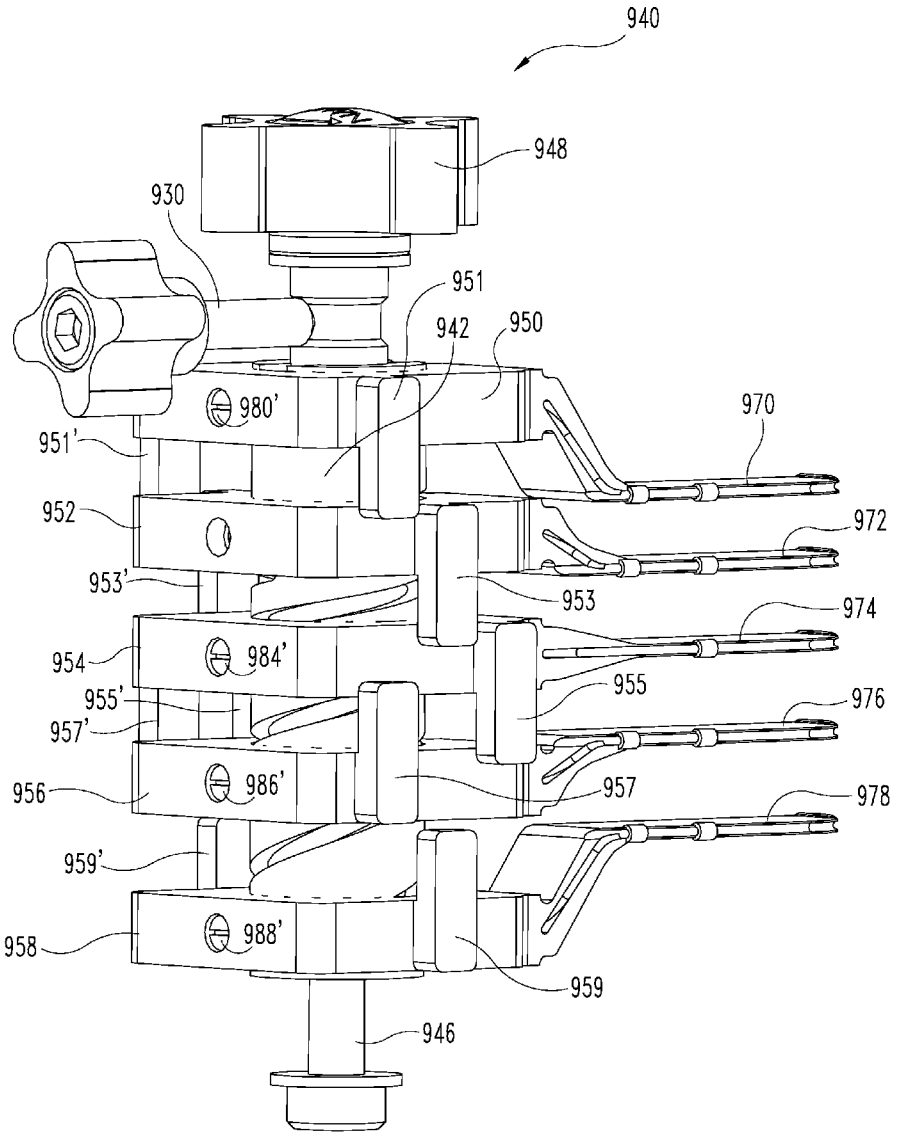
FIG. 28 is a perspective detailed view of the adjustment mechanism of FIG. 26.
Figure 29:
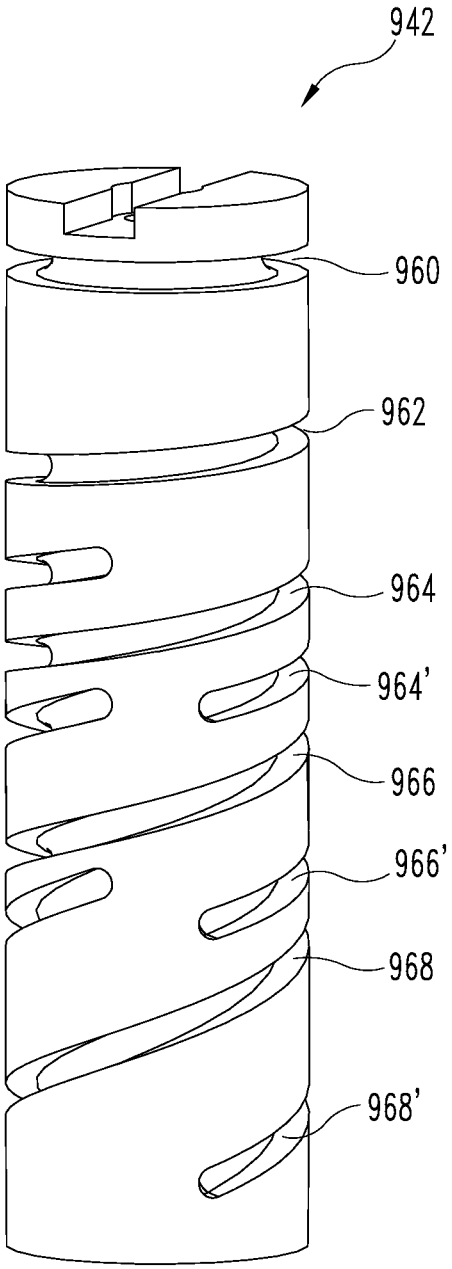
FIG. 29 is a perspective view of the body portion of the adjustment mechanism of FIG. 28.
Figure 30:
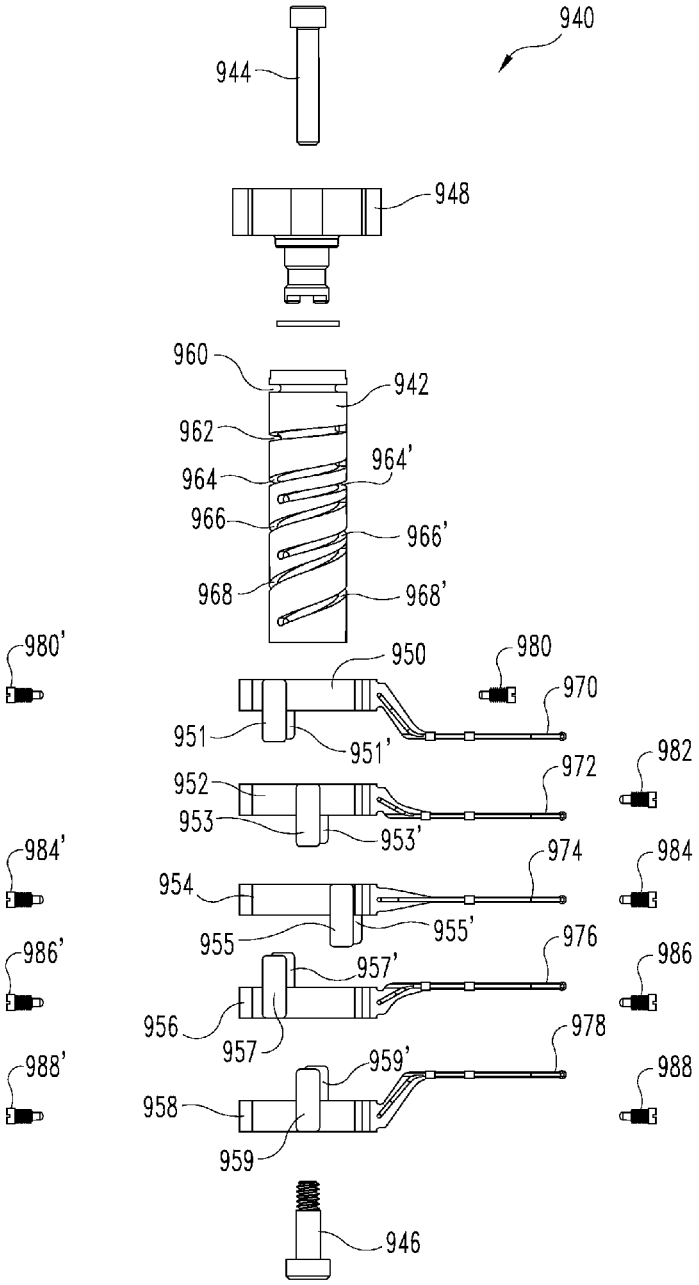
FIG. 30 is an exploded view of the adjustment mechanism of FIG. 28.

Adjustment mechanism 840 is mounted to sight block 812. In certain embodiments, adjustment mechanism 840 is enclosed within a cover 822, which optionally may be transparent or opaque. Cover 822 may optionally extend over the front of sight guard 814 to enclose fiber optic strands leading to the sight pins. Cover 822 is illustrated as a transparent cover in FIG. 22 and is not illustrated in FIG. 23 for clarity. The adjustment mechanism 840 of FIGS. 22, 23 and 25 is illustrated separately from the overall sight assembly in FIG. 24 for ease of reference.

Adjustment mechanism 840 includes a cylindrical or barrel shaped body portion 842. Body portion 842 is rotatable around a vertical axis aligned with axle portions 846. Body portion 842 may be made integrally with the axle portions or axle pieces may be mounted to and to extend from each end of body portion 842. The upper end of an axle portion 846 can be engaged to be controlled and rotated by control knob 848, which correspondingly rotates body portion 842. Body portion 842 defines spirally curved and eccentrically spaced curved track portions 862, 864, 866 and 868

Assembly 810 includes horizontal sight pins 870, 872, 874, 876 and 878 with respective bases 850, 852, 854, 856 and 858. In the illustrated embodiment, sight pin 870 with base 850 is arranged at a fixed height relative to guard 812, while the heights of sight pins 872, 874, 876 and 878 are adjustable. In the illustrated embodiment, sight pin 870 is maintained at a fixed height via base 850 which extends into and is engaged with horizontal track 860. Bases 852, 854, 856 and 858 of the movable pins extend and engage respective spirally wound tracks 862, 864, 866 and 868 defined in body portion 842. The pins may be formed of one or more pieces and the base portions may be integral or separate and mounted to the pins.

As illustrated, pin bases 850, 852, 854, 856 and 858 define adjustment passages arranged around a vertical shaft 818. The engagement of pins 870, 872, 874, 876 and 878 to the shaft allows the pins to be slidably adjusted in height along the shaft, although pin 870 does not change in height in the embodiment illustrated. In certain embodiments, shaft 818 and the pin passages have matching non-circular cross-sections to prevent the pins from rotating horizontally around the shaft. A rectangular cross-section is illustrated.

Pin bases 852, 854, 856 and 858 are slidably engaged in spiral tracks 862, 864, 866 and 868 such that rotation of body portion 842 clockwise or counter-clockwise causes the tracks to apply force to urge pins 872, 874, 876 and 878 to adjust their respective heights along shaft 818 as determined by the curves of tracks 862, 864, 866 and 868. The engagement may be direct such as a tab-in-slot engagement, or alternately may use a ball bearing arrangement, low-friction materials such as Delrin® plastic or a similar structure to facilitate sliding and movement of the bases within the tracks. The position and curvature of the track portions is preferably calculated to maintain the desired proportional spacing of the respective pin heights as the pins are adjusted.

In alternate embodiments, a middle or lower pin can remain fixed in height, with the curvature and positioning of the track portions arranged relative to the height of the fixed pin. For example, middle pin 874 could be arranged at a fixed height either as directly connected to shaft 818 or with a base engaged in a circular track portion. Other track portions would then increase or decrease the positions of pins 870, 872, 876 and 878 relative to pin 874 when the mechanism's body portion is rotated.

In use, the sight assembly 810 is adjusted so that first pin 870, or alternately a selected pin of fixed height, is calibrated to a first distance. The adjustment mechanism 840 is used to adjust a second pin to a second distance. After correctly aligning the first and second pins, the remaining pins will already be adjusted to corresponding distances.

FIGS. 26-32 illustrate a bow sight assembly 910 with an integrated adjustment mechanism 940. Sight assembly 910 includes a rearward base portion 916, to which a sight body assembly 918 may be selectively vertically and horizontally mounted. Sight body assembly 918 includes a sight block 912 and a sight guard 914. Sight block 912 includes a rear housing portion 922 and a front cover piece 924 which closes the front side of housing 922. Optionally a transparent fiber cover 926 is arranged around the front face of sight guard 914 to enclose fiber optic strands leading to the sight pins. Other accessories, such as a level or sight light may optionally be used with assembly 910.

Adjustment mechanism 940 is mounted to sight block 912 within housing 922. A selective locking mechanism, such as locking screw 930 may extend into housing 922 to engage adjustment mechanism 940. Cover piece 924 and fiber cover 926 are not illustrated in FIG. 27 for clarity. Aspects of adjustment mechanism 940 are illustrated separately or with portions of the overall sight assembly 910 in FIGS. 28-32 for ease of reference. The inclusion or omission of portions in specific figures is not intended to be limiting.

Adjustment mechanism 940 includes a cylindrical or barrel shaped body portion 942. Body portion 942 is rotatable around a vertical axis aligned with axle portions. Body portion 942 made be made integrally with the axle portions or using separate axle pieces, such as upper and lower bolts 944 and 946 which may be mounted to extend into each end of body portion 942. The bolts extend through housing 922 and may include bushings, bearings or washers to facilitate rotation through openings in housing 922. The upper end of body portion 942 can be engaged to be controlled and rotated by rotatable control knob 948. For example, control knob 948 is illustrated with a slot-and-groove keyed relationship to the upper face of body 942.

Body portion 942 defines an upper horizontal/circular track 960, and four spirally curved and eccentrically spaced curved track portions 962, 964, 966 and 968 in proportional spacing. In tracks having sufficient spiral height, equal and parallel or paired tracks 964', 966' and 968 are each defined at a 180 degree offset from tracks 964, 966 and 968 respectively. In the illustrated embodiment, the spiral height of track 962 is insufficient to allow clearance for a parallel track. Assembly 910 includes horizontal sight pins 970, 972, 974, 976 and 978 with respective bases 950, 952, 954, 956 and 958 arranged to engage tracks 960, 962, 964, 966 and 968. In alternate embodiments, additional sight pins and tracks can be included.

As illustrated, pin bases 950, 952, 954, 956 and 958 are arranged around and engage body portion 942. Specifically, guide pins extend through the bases into the guide tracks. For example as illustrated, two threaded guide pins 980 and 980' extend through base 950 into horizontal track 960. Base 952 includes a single guide pin 982 which extends into track 962. Tracks 964, 966 and 968 with paired offset tracks 964', 966' and 968', are engaged by pairs of guide pins 984 and 984', 986 and 986' and 988 and 988' respectively engaging bases 954, 956 and 958.

The guide pins are slidably engaged in the tracks such that rotation of body portion 942 clockwise or counter-clockwise causes the tracks to apply force to urge the guide pins, and corresponding the sight pin bases to adjust their respective heights as determined by the curves of the tracks. The guide pins optionally can be advanced or retracted into deeper or shallower engagement with the tracks to control the frictional resistance. Preferably, the guide pin tips are machined in a suitable profile and/or are formed with a suitable coating or material to assist the guide pins to freely slide within the tracks during adjustment of mechanism 940. As examples, the guide pin tips may be machined with rounded tips, coated with a low-friction material such as a Teflon® or formed using a low-friction material such as Dekin® plastic. The position and curvature of the track portions is preferably calculated to maintain the desired proportional spacing of the respective pin heights as the pins are adjusted.

In alternate embodiments, a middle or lower pin can remain fixed in height, with the curvature and positioning of the track portions arranged relative to the height of the fixed pin. For example, middle pin 974 could be arranged at a fixed height either as directly connected to sight block 912 or with a base engaged to body 942 in a circular track portion. Other track portions would then increase or decrease the positions of pins 970, 972, 976 and 978 relative to pin 974 when the mechanism's body portion is rotated.

Figure 31:
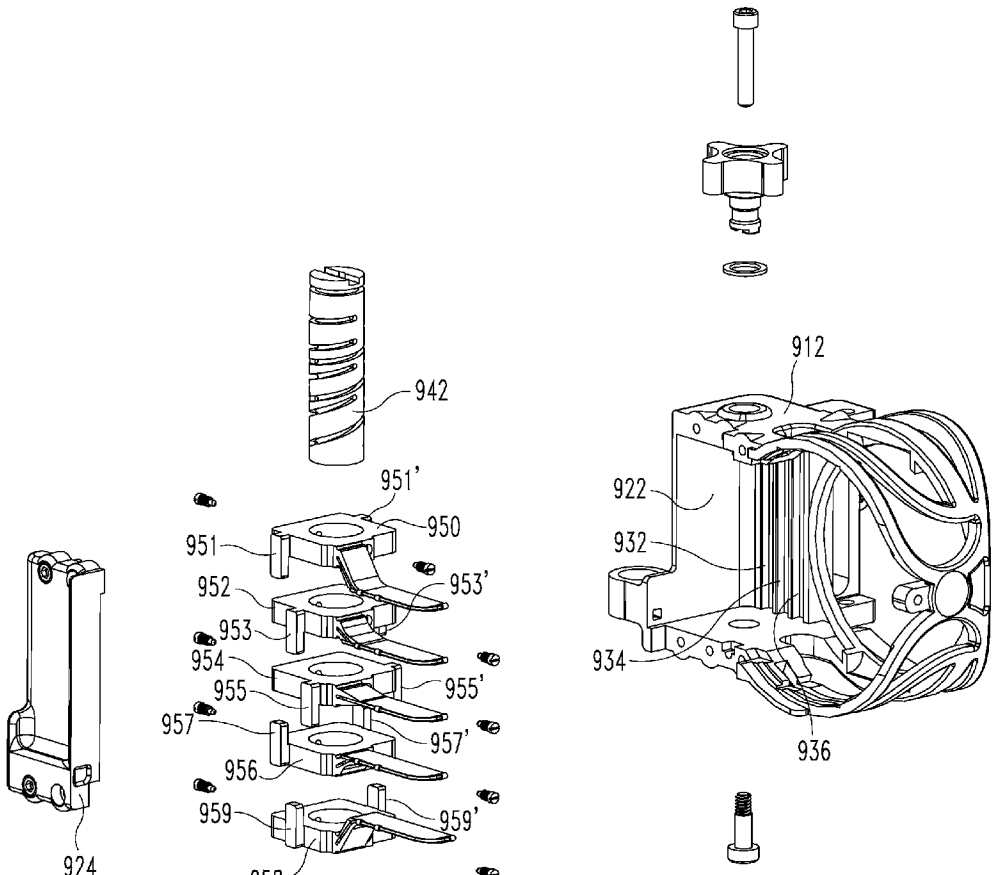
FIG. 31 is an exploded view of the adjustment mechanism of FIG. 28 along with the sight block and cover piece.
Figure 32:
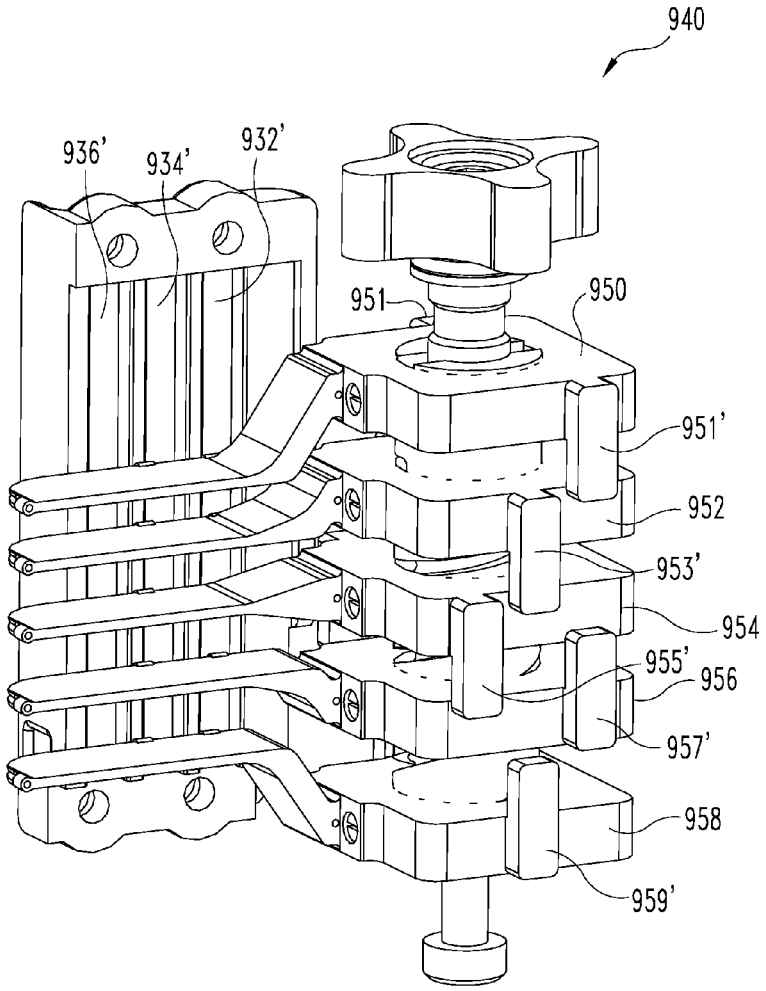
FIG. 32 is a perspective view of the adjustment mechanism of FIG. 28 with the cover piece.

When assembled into housing 922, bases 950, 952, 954, 956 and 958 include alignment tabs which slidably engage tracks defined in interior sidewalls of housing 922 and/or cover 924. One, two or more tabs may optionally be used per base. The alignment tabs are preferably vertically slidable to allow adjustment of the respective bases, yet resist undesired horizontal rotation of the bases without housing 922. As illustrated in FIGS. 31 and 32, bases 950, 952, 954, 956 and 958 each preferably include a pair of alignment tabs, 951 and 951', 953 and 953', 955 and 955', 957 and 957', and 959 and 959' arranged on opposing front and rear sides of the respective bases. Alternately, the tracks can be arranged on other sidewalls. The tabs each engage at least one vertical track, such as tracks 932, 934 and 936 defined in housing 922 or tracks 932', 934' and 936' defined in cover piece 924. The alignment tabs are preferably offset to respective tracks and may have a height that extends upward or downward from the bases, yet are spaced in an arrangement that allows each base to be vertically adjusted within a maximum range of desired movement without the tabs of different bases interfering with each other.

In use, the sight assembly 910 is adjusted so that first pin 970, or alternately a selected pin of fixed height, is calibrated to a first distance. The adjustment mechanism 940 is used to adjust a second pin to a second distance. After correctly aligning the first and second pins, the remaining pins will already be adjusted to corresponding distances. Locking screw 930 may then be advanced or tightened to engage adjustment mechanism 940, locking the mechanism at a fixed position.

Figure 33:
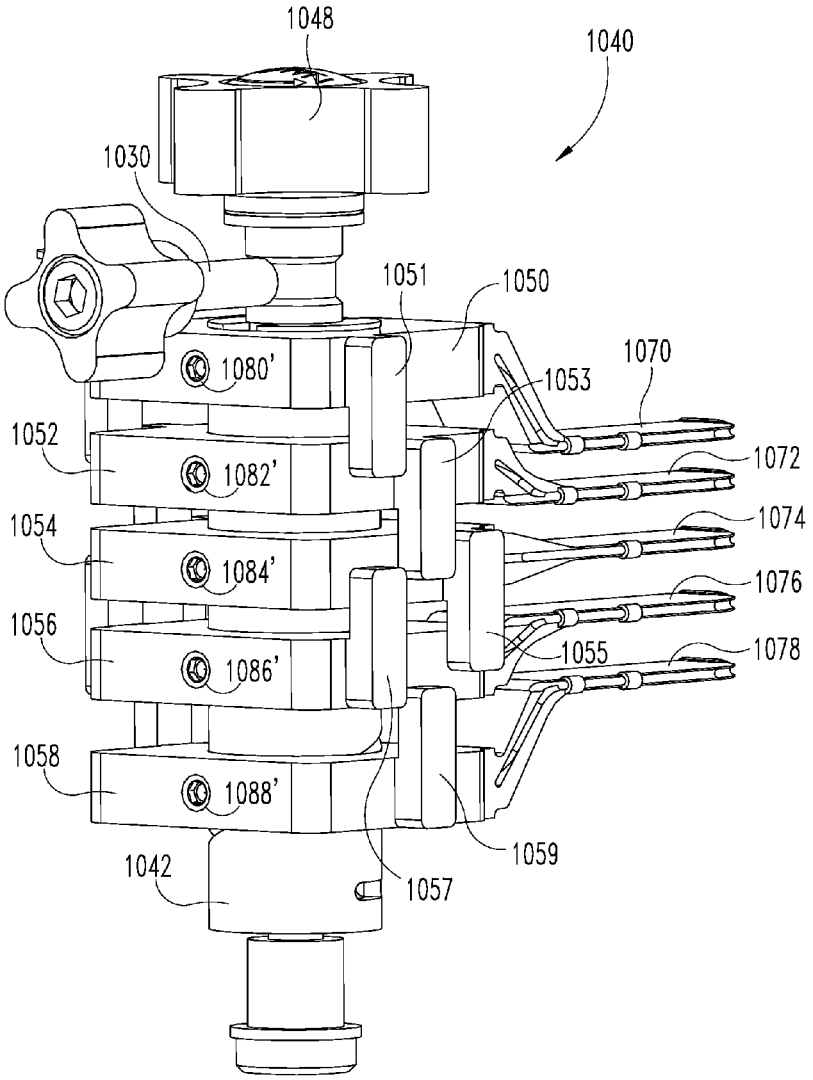
FIG. 33 is a perspective detailed view of an alternate adjustment mechanism usable with the embodiment of FIG. 26.
Figure 34:
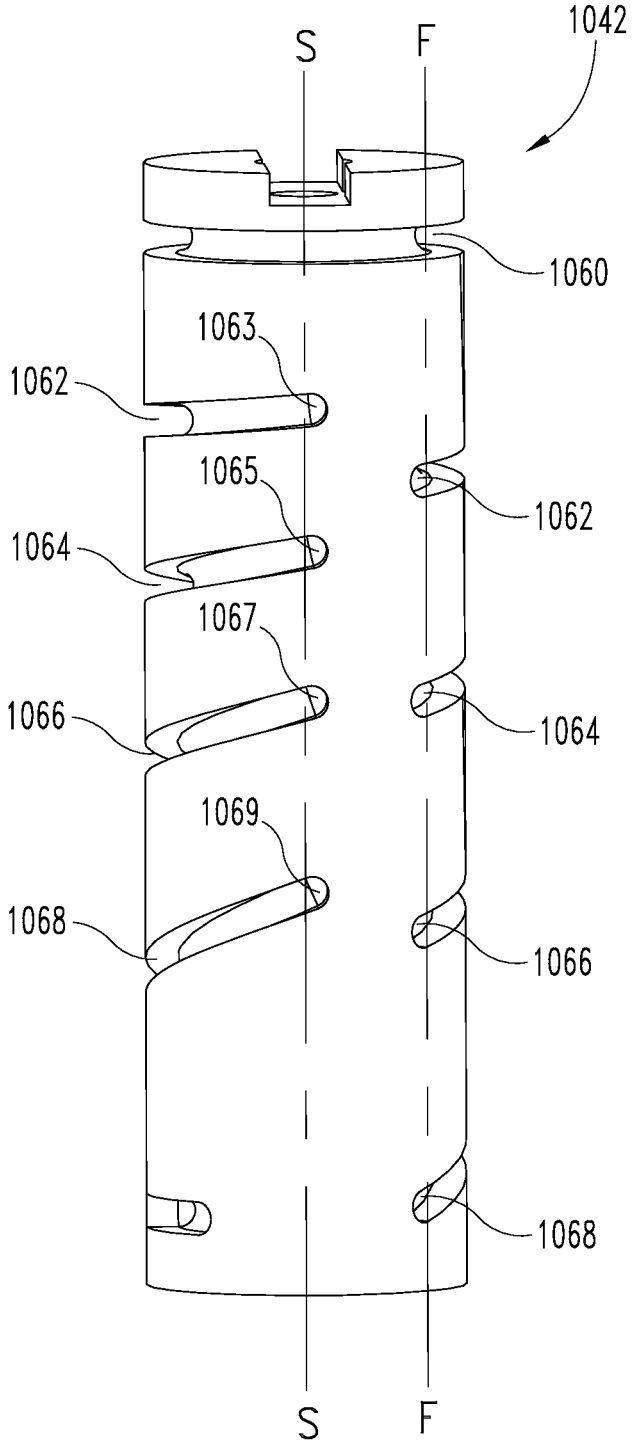
FIG. 34 is a perspective view of the body portion of the adjustment mechanism of FIG. 33.
Figure 35:
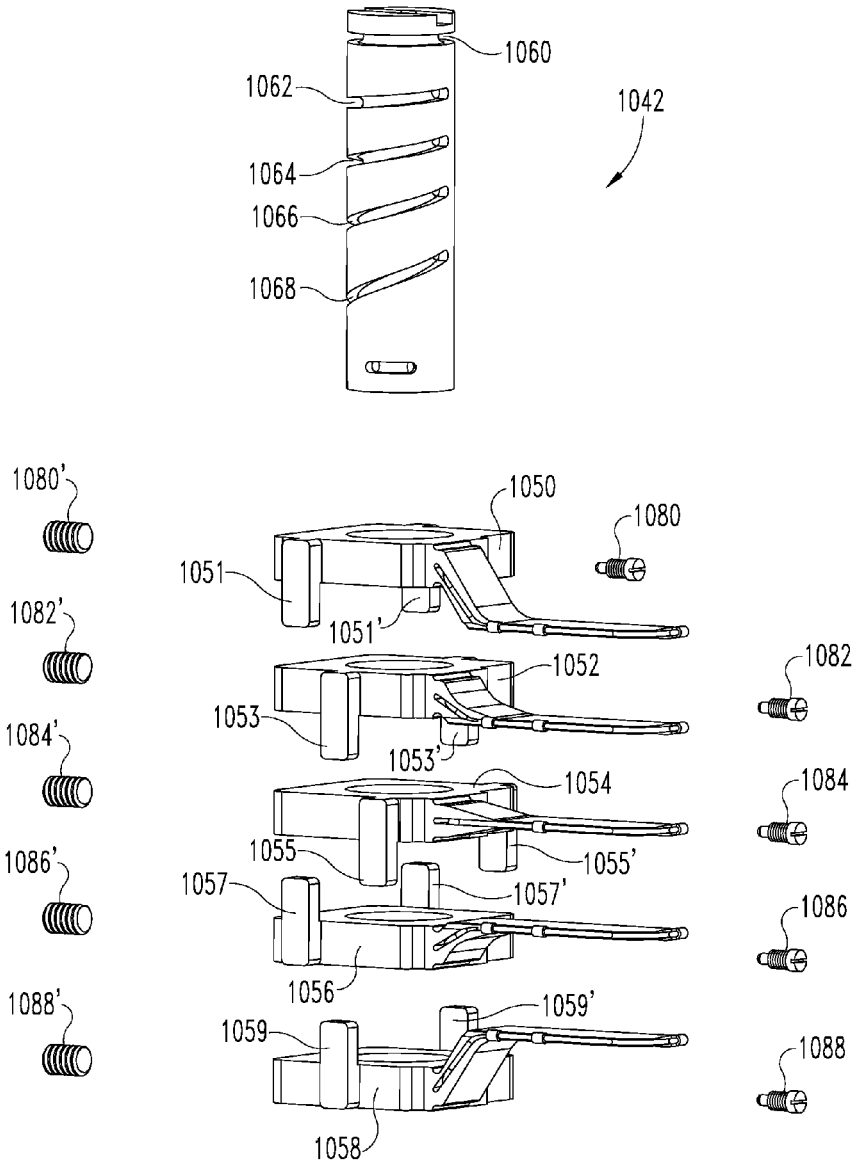
FIG. 35 is an exploded view of portions of the body portion and pins of FIG. 33.

FIGS. 33-35 illustrate an embodiment of an adjustment mechanism 1040 which may be used within sight assembly 910 as an alternate to adjustment mechanism 940. Specifically, the adjustment mechanism 1040 illustrated in FIG. 33 may be mounted within housing 922 of sight block 912. A selective locking mechanism, such as locking screw 1030 may extend into housing 922 to engage adjustment mechanism 1040. Portions of adjustment mechanism 1040 are illustrated in FIGS. 33-35 without all aspects shown for ease of reference. The inclusion or omission of portions in specific figures is not intended to be limiting.

Adjustment mechanism 1040 includes a cylindrical or barrel shaped body portion 1042. Body portion 1042 is rotatable around a vertical axis aligned with axle portions. Body portion 1042 made be made integrally with the axle portions or using separate axle pieces, such as upper and lower bolts which may each engage an end of body portion 1042. The bolts extend through housing 922 and may include bushings, bearings or washers to facilitate rotation through openings in housing 922. The upper end of body portion 1042 can be engaged to be controlled and rotated by rotatable control knob 1048.

As illustrated in detail in FIG. 34, body portion 1042 defines an upper horizontal/circular track 1060, and for example four spirally curved and proportionally spaced curved track portions 1062, 1064, 1066 and 1068. In certain embodiments each of the spirally wound guide tracks has a starting or highest effective travel point 1063, 1065, 1067, 1069 aligned along a shared vertical axis S-S. In the illustrated embodiment, each spiral track winds around body portion less than one full revolution, for example approximately ⅞ths of a revolution, although longer or shorter tracks can be used as spacing allows. When the uppermost pin is a reference pin which is effectively fixed in height, the starting points of lower tracks are generally the highest points of each track and correspond to the closest height spacing of the respective pins. Alternately, if a middle or lower pin is the reference pin, the middle or lower track would be horizontal and the higher or lower tracks would diverge upwardly and downwardly respectively.

As illustrated, the spirally wound tracks diverge in proportional vertical spacing as the tracks wind around body portion 1042. In certain embodiments, the tracks each wind around the circumference of body portion 1042 the same number of degrees horizontally while diverging vertically. Accordingly, the end or lowest points of each tracks are also aligned along a shared vertical axis F-F.

In certain embodiments, one or more of the tracks may physically have a length longer than the usable travel distance associated with that pin and track, in which situation the excess track length is effectively unusable, rendering the effective starting or ending point the point corresponding to the usable travel distance of the pin and track. References to the track starting and ending points or highest and lowest points herein are intended for refer to the effective points usable on the track even if the physical track has excess length.

In alternate embodiments, the starting points and ending points of respective tracks do not have to be aligned along a shared vertical axis; however, the tracks need to be synchronized to allow for rotation of body portion 1042 to simultaneously affect each of the pins while maintaining the desired proportional spacing. For example, the respective horizontal spacing of the respective upper track travel points could define a horizontal spacing pattern around the circumference of body portion 1042, which is matched by the horizontal spacing pattern of the respective lower track points. The track with the shortest horizontal degrees of revolution will define the rotation limits of body portion 1042.

Mechanism 1040 includes horizontal sight pins 1070, 1072, 1074, 1076 and 1078 with respective bases 1050, 1052, 1054, 1056 and 1058 arranged to engage tracks 1060, 1062, 1064, 1066 and 1068 in body portion 1042. In alternate embodiments, additional sight pins and tracks can be included. Pin bases 1050, 1052, 1054, 1056 and 1058 are arranged around and engage body portion 1042. Specifically, guide pins extend through the bases into the guide tracks. In the example illustrated, set screws also extend through the bases against the body portion 1042 opposite the guide pins. For example as illustrated, one threaded guide pin 1080 extends through each of bases 1050, 1052, 1054, 1056, and 1058 and into each of horizontal tracks 1060, 1062, 1064, 1066 and 1068. Further, set screws 1080', 1082', 1084', 1086' and 1088' extend through each of bases 1050, 1052, 1054, 1056, and 1058 and each set screw has an inward surface that abuts body portion 1042 opposite a guide pin. As illustrated, the set screws have a diameter larger than the height of the guide tracks, and the set screws do not extend into the tracks. Preferably, the guide pin tips and/or the set screws are machined in a suitable profile and/or are formed with a suitable coating or material to assist the guide pins and set screws to freely slide during adjustment of mechanism 1040. For example, nylon set screws may be used.

The set screws and guide pins can each be advanced or retracted to balance and stabilize a pin base relative to body portion 1042 and to control frictional resistance. In one process of assembly, a pin base, for example base 1052, may be placed around body portion 1042 and then a guide pin, such as guide pin 1082 may be advanced into track 1062 through base 1052 to locate the pin base relative to the track. The tip of guide pin 1082 may extend into track 1062 between the upper and lower walls, but the tip may be slightly spaced away from the inner diameter wall of guide track 1062. A set screw, such as screw 1082' is then advanced against the outer diameter surface of body portion 1042 to stabilize base 1052 and to control frictional resistance between the base and the body portion.

The guide pins are slidably engaged in the tracks such that rotation of body portion 1042 clockwise or counter-clockwise causes the tracks to apply force to urge the guide pins, and corresponding the sight pin bases to adjust their respective heights as determined by the curves of the tracks. The degrees of revolution around the circumference of body portion 1042 of each track determine the degrees of rotation of body portion to cause the sight pins to travel from their closest spaced apart distance to their largest spaced apart distance. For example, if the degrees of revolution travel ⅞ths of the way around body portion 1042, control knob 1048 can be adjusted within limits defines by $\frac{7}{8}^{th}$ of a revolution and/or anywhere in between those limits. In certain preferred embodiments, each spiral track winds around body portion 1042 less than or equal to one full revolution, although alternately longer or shorter degrees of revolution can be used as spacing allows.

When assembled into housing 922, bases 1050, 1052, 1054, 1056 and 1058 include alignment tabs 1051, 1051', 1053, 1053', 1055, 1055', 1057, 1057', 1059 and 1059' which slidably engage tracks 932, 934, 936, 932', 934' and 936' defined in sidewalls of housing 922 and/or cover 924 in the same manner as discussed above with respect to bases 950, 952, 954, 956 and 958.

In use, the sight assembly 910 with alternate adjustment mechanism 1040 used and adjusted in substantially the same manner as sight assembly 910 with adjustment mechanism 940.

Certain illustrated embodiments shows a mechanism which may be manually adjusted by expansion, contraction or rotation. Alternately, a mechanical control can be used in any of the embodiments to allow fine adjustments of the expansion, contraction or rotational movement.

Conventional materials may be used to make embodiments of the archery sights disclosed. Examples of such materials include metals such as aluminum, steel or titanium or plastic component pieces as appropriate. Appropriate connectors and fasteners such as screws and pins are used to assemble the archery sights, some of which have been illustrated, but not all of which have been discussed in detail. Appropriate use of such connectors as illustrated herein will be understood by those with skill in the art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An archery bow sight assembly mountable to an archery bow, comprising:

a sight block;

an adjustment mechanism mounted to said sight block, said adjustment mechanism including a linkage arrangement including a plurality of pairs of linkage arms which can be expanded or retracted vertically downward relative to an upper base on said sight block;

wherein the linkage arms in each pair are connected to each other in a pivotal x arrangement, and wherein each pair of linkage arms defines a pair of upper pivot points and a pair of lower pivot points;

wherein a first pair of linkage arms is pivotally connected to said upper base at a first pair of upper pivot points, and wherein the remaining pairs of linkage arms are connected in series such that the upper pair of pivot points of each succeeding pair forms a pair of shared pivot points with the lower pivot points of the preceding pair; and, wherein the upper and lower pivot point pairs define respective desired sight point locations which are vertically adjusted by expansion and retraction of said linkage arrangement.

2. The archery bow sight assembly of claim 1, wherein each pair of linkage arms defines a length and wherein the length defined by each pair of linkage arms differs from the lengths of the remaining pairs of linkage arms.

3. The archery bow sight assembly of claim 2, wherein the length of each succeeding pair of linkage arms is longer than the length of the preceding pair.

4. The archery bow sight assembly of claim 1, comprising four pairs of linkage arms.

5. The archery bow sight assembly of claim 1, comprising a plurality of sight pins mounted on said sight block, wherein said sight pins can be individually adjusted to match the desired sight point locations.

6. The archery bow sight assembly of claim 1, comprising a plurality of pointer arms secured to said linkage assembly at said upper and lower pivot point pairs, wherein each pointer arm designates the height where a corresponding sight pin should be aligned.

7. The archery bow sight assembly of claim 1, comprising a plurality of horizontal alignment bars with a horizontal alignment bar arranged at each of said upper and lower pivot point pairs.

8. The archery bow sight assembly of claim 7, wherein the lower pivot points of each pair of linkage arms are rotatably and slidably mounted to a horizontal alignment bar.

9. The archery bow sight assembly of claim 7, wherein each horizontal alignment bar defines at least one slot adjacent an end.

10. The archery bow sight assembly of claim 1, wherein said sight block comprises a worm gear which is threadably engaged to said linkage arrangement via a worm gear mount, wherein said worm gear mount travels upward or downward corresponding to rotation of said worm gear and correspondingly expands and contracts said linkage arrangement.

11. An archery bow sight assembly mountable to an archery bow, comprising:

a sight block;

a sight guard extending from said sight block;

a tool selectively mountable to said sight guard, the tool having an adjustment mechanism, said adjustment mechanism including a linkage arrangement including a plurality of pairs of linkage arms which can be expanded or retracted vertically downward relative to an upper base on said sight block;

wherein each pair of linkage arms defines a pair of upper pivot points and a pair of lower pivot points;

wherein a first pair of linkage arms is pivotally connected to said upper base at a first pair of upper pivot points, and wherein the remaining pairs of linkage arms are connected in series such that the upper pair of pivot points of each succeeding pair forms a pair of shared pivot points with the lower pivot points of the preceding pair; and, wherein the upper and lower pivot point pairs define respective desired sight point locations which are vertically adjusted by expansion and retraction of said linkage arrangement.

12. The archery bow sight assembly of claim 11, wherein each pair of linkage arms defines a length and wherein the length defined by each pair of linkage arms differs from the lengths of the remaining pairs of linkage arms.

13. The archery bow sight assembly of claim 12, wherein the length of each succeeding pair of linkage arms is longer than the length of the preceding pair.

14. The archery bow sight assembly of claim 11, comprising a plurality of sight pins mounted on said sight block, wherein said sight pins can be individually adjusted to match the desired sight point locations.

15. An archery bow sight assembly mountable to an archery bow, comprising:

a sight block;

an adjustment mechanism mounted to said sight block, said adjustment mechanism including a linkage arrangement which can be expanded or retracted vertically relative to said sight block;

wherein the linkage arrangement defines a plurality of vertically adjustable desired sight point locations which proportionally change relative to each other in height by expansion and retraction of said linkage arrangement.

16. The archery bow sight assembly of claim 15, comprising a plurality of sight pins mounted on said sight block, wherein said sight pins can be individually adjusted to match the desired sight point locations.

17. The archery bow sight assembly of claim 15, wherein said linkage assembly comprises a plurality of pointer arms at said desired sight point locations wherein each pointer arm designates the height where a corresponding sight pin should be aligned.

18. The archery bow sight assembly of claim 15, wherein said linkage assembly comprises a plurality of sight pins at said desired sight point locations.

* * * * *